US005564597A

United States Patent [19]

Koorse et al.

[11] Patent Number: 5,564,597

[45] Date of Patent: Oct. 15, 1996

[54] PORTABLE FOOD AND BEVERAGE SYSTEM

[76] Inventors: Lee R. Koorse, 21667 Cromwell Cir., Boca Raton, Fla. 33486; Mark M. McCool, 1505 NE. 2nd St., Pompano Beach, Fla. 33061

[21] Appl. No.: 183,188

[22] Filed: Jan. 18, 1994

[51] Int. Cl.[6] ..... A47F 1/04

[52] U.S. Cl. ..... 221/96; 221/310; 222/185.1; 62/457.4

[58] Field of Search ..... 221/96, 97, 244, 221/279, 221, 303, 307, 310; 222/132, 185, 131, 183, 401; 62/457.4, 457.5, 389

[56] References Cited

U.S. PATENT DOCUMENTS

| | | | |
|---|---|---|---|
| 2,022,570 | 11/1935 | Munters | 62/389 X |
| 2,644,578 | 7/1953 | Bramming | 206/65 |
| 3,280,591 | 10/1966 | Webster | 62/390 |
| 3,338,068 | 8/1967 | Piker | 62/398 |
| 3,434,629 | 3/1969 | Hooge et al. | 221/96 X |
| 3,604,592 | 9/1971 | Bacon et al. | 221/96 |
| 3,802,220 | 4/1974 | Pompo | 62/530 |
| 3,807,194 | 4/1974 | Bond | 62/457 |
| 3,896,977 | 7/1975 | Bergstrom | 222/183 X |
| 4,126,248 | 11/1978 | House | 221/279 X |
| 4,143,795 | 3/1979 | Casebier | 222/185 X |
| 4,234,101 | 11/1980 | Pastore | 221/279 X |
| 4,280,336 | 7/1981 | Taylor | 62/457 |
| 4,344,300 | 8/1982 | Taylor | 62/457 |
| 4,344,301 | 8/1982 | Taylor | 62/457 |
| 4,438,637 | 3/1984 | Atkinson | 62/457 |
| 4,481,792 | 11/1984 | Groeger et al. | 62/457 |
| 4,607,502 | 8/1986 | Tomac | 62/294 |
| 4,628,705 | 12/1986 | Nave | 62/457 |
| 4,747,274 | 5/1988 | Duemmig-Zitzmann | 62/371 |
| 4,795,059 | 1/1989 | Sanders et al. | 221/183 X |
| 5,009,028 | 4/1991 | Lorenzana et al. | 222/185 X |
| 5,024,067 | 6/1991 | Maier, II | 62/457.4 |
| 5,095,718 | 3/1992 | Ormond et al. | 62/457.5 |
| 5,335,829 | 8/1994 | Sovann | 222/185 X |

FOREIGN PATENT DOCUMENTS

| | | | |
|---|---|---|---|
| 209569 | 7/1957 | Australia | 62/457.5 X |
| 297294 | of 1932 | Italy | 222/401 X |

*Primary Examiner*—William E. Terrell
*Assistant Examiner*—Dean A. Reichard
*Attorney, Agent, or Firm*—John C. Smith

[57] ABSTRACT

A portable container beverage dispensing system. The beverage dispenser uses the original beverage container which is inverted and loaded into a sleeve inside the beverage dispensing system. A conduit is attached to the beverage container which is in turn attached to a spigot which is accessible from the outside of the portable container. The beverage is gravity fed to the spigot. The beverage container is insulated from external temperature problems, and is held in close proximity to thermal control devices to provide more efficient beverage temperature control. The sleeve may alternatively be used as a reservoir, for an optional cup dispenser is provided, or for an optional storage container. An optional pump is provided to maintain pressure inside the reservoir for adequate beverage flow rate.

7 Claims, 24 Drawing Sheets

PORTABLE FOOD AND BEVERAGE SYSTEM

BACKGROUND OF THE INVENTION

1. Technical Field

The present invention relates to containers. Particularly, to portable containers for use in storing beverages and/or food.

2. Background Art

A variety of container devices designed for the temporary storage of food and beverages are known in the art. These containers have found use both for recreational purposes as well as by workers whose jobs are an inconvenient distance from alternative commercial dining facilities.

Historically, box-like picnic baskets were first used to hold food. As technology advanced, materials were developed which provided insulation for the contents of the container. As a result, food and beverage items (both hot and cold) were provided with an extended period of time in which they maintained a temperature suitable for the particular item. These new insulating materials, while providing protection from external temperatures, did not address the inconvenience created by many loose beverage cans and bottles stored within the container.

Other attempts were made to address problems associated with the handling of beverage cans and bottles. For example, some liquids, such as non-carbonated drinks, could be transferred to insulated bottles without substantial loss in quality. However, a problem associated with this approach is the loss of carbonation which occurs when carbonated soft drinks or beers are transferred from one container to another. As a result, prior art insulated liquid containers are only effective for a limited selection of beverages.

Temperature control is another area where improvements have been made. In particular, a number of methods of cooling have been used, such as ice, dry ice, reusable "blue-ice" blocks, etc. Likewise, attempts to provide heat have also been made for warm beverages such as coffee or tea. Prior approaches to maintaining heat have included methods such as hot water bottles, electric heaters, etc. In both areas, maintaining cold or heat, the construction of prior art container devices has limited the effectiveness of thermal control devices because they are typically not physically positioned such that optimal thermal transfer is accomplished. Further, in both situations the thermal stability of beverage containers is adversely effected because they are exposed to adverse weather, removed from proximity to thermal control devices during use, and subjected to thermal conductivity which results from user handling of the beverage can or bottle.

While addressing many problems, the prior art has failed to provide a system which allows carbonated and non-carbonated beverages to be dispensed from their original containers while still in close proximity to their respective thermal control devices and insulated from external temperatures.

SUMMARY OF THE INVENTION

The foregoing problems associated with inadequate temperature control, loss of carbonation, and inconvenience are solved by the portable container beverage dispensing system disclosed herein. The beverage dispenser uses the original beverage container which is inverted and loaded into a sleeve inside the beverage dispensing system. A conduit is attached to the beverage container which is in turn attached to a spigot which protrudes from the outside of the portable container. The beverage is gravity fed to the spigot. The beverage container is insulated from external temperature problems, and is held in close proximity to thermal control devices to provide more efficient beverage temperature control. The sleeve may alternatively be used as a reservoir by disconnecting the conduit from the spigot and removing it from the sleeve. The internal side of the spigot will then open directly into the sleeve. An optional pump is provided to maintain pressure inside the reservoir for adequate beverage flow rate. An optional cup dispenser is provided.

DESCRIPTION OF THE PREFERRED EMBODIMENT

Figure 1:
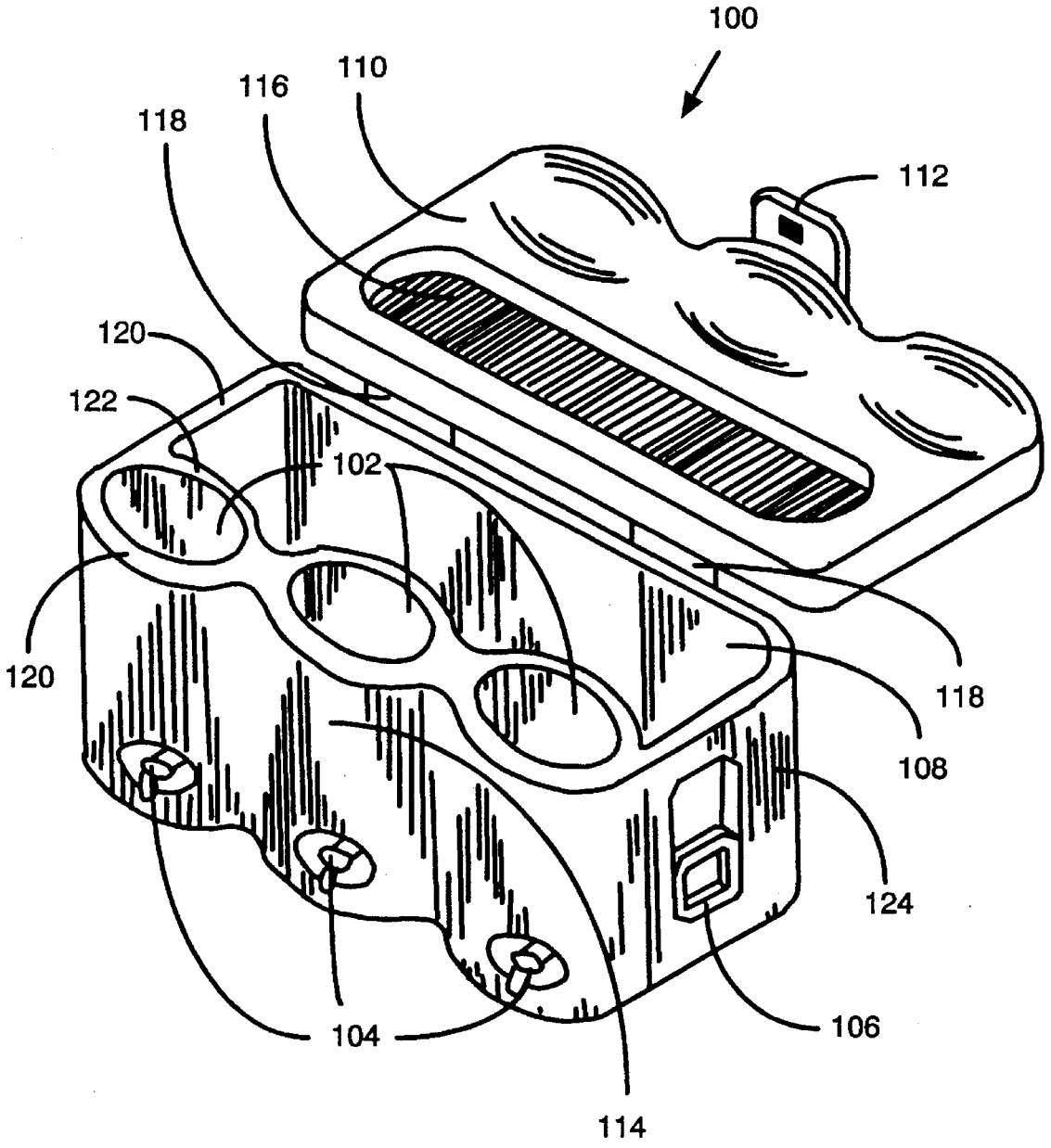
FIG. 1 is a diagram showing a portable container with the dispenser system with the lid in the open position.

Referring to FIG. 1, a preferred embodiment of the invention is shown. In this embodiment, portable container 100 is comprised of lower container body 124 and lid 110. The lid 110 is shown attached to lower container body 124 by hinges 118, but may also be attached by any other suitable means such as pressure fit. Lid 110 has a latch 112 which secures to lock 114 when container 100 is closed. Handles 106 fold out from lower container body 124 during transport.

Lower container body 124 is formed by a floor portion (not shown) and perimeter wall 120. In the preferred embodiment, portable container 100 is constructed from any suitable insulating material. Materials used for portable containers are well known in the art. Inner wall 122 connects with perimeter wall 120 to form sleeves 102. Spigots 104 enter sleeves 102 near the base of perimeter wall 120. Any suitable spigot design can be used, such as a push button or lever style. Further, while three sleeves 102 are shown in this embodiment, as little as one sleeve 102 or as many as can be conveniently located within portable container 100 can be used. In addition, multiple sleeves 102 provide the ability to supply a variety of hot and cold beverages from portable container 100.

Indented area 116 is shown in lid 110. Indented area 116 can be used to increase the total storage area of portable container 100. It can also be equipped with a cover (not shown) to provide storage for beverage conduits (discussed below), etc. Alternatively, the surface of indented area 116 can be covered with hook and loop material. By so doing, a wide variety of accessories and personal items can be secured in indented area 116 by strips of hook and loop material acting as straps.

Figure 2:
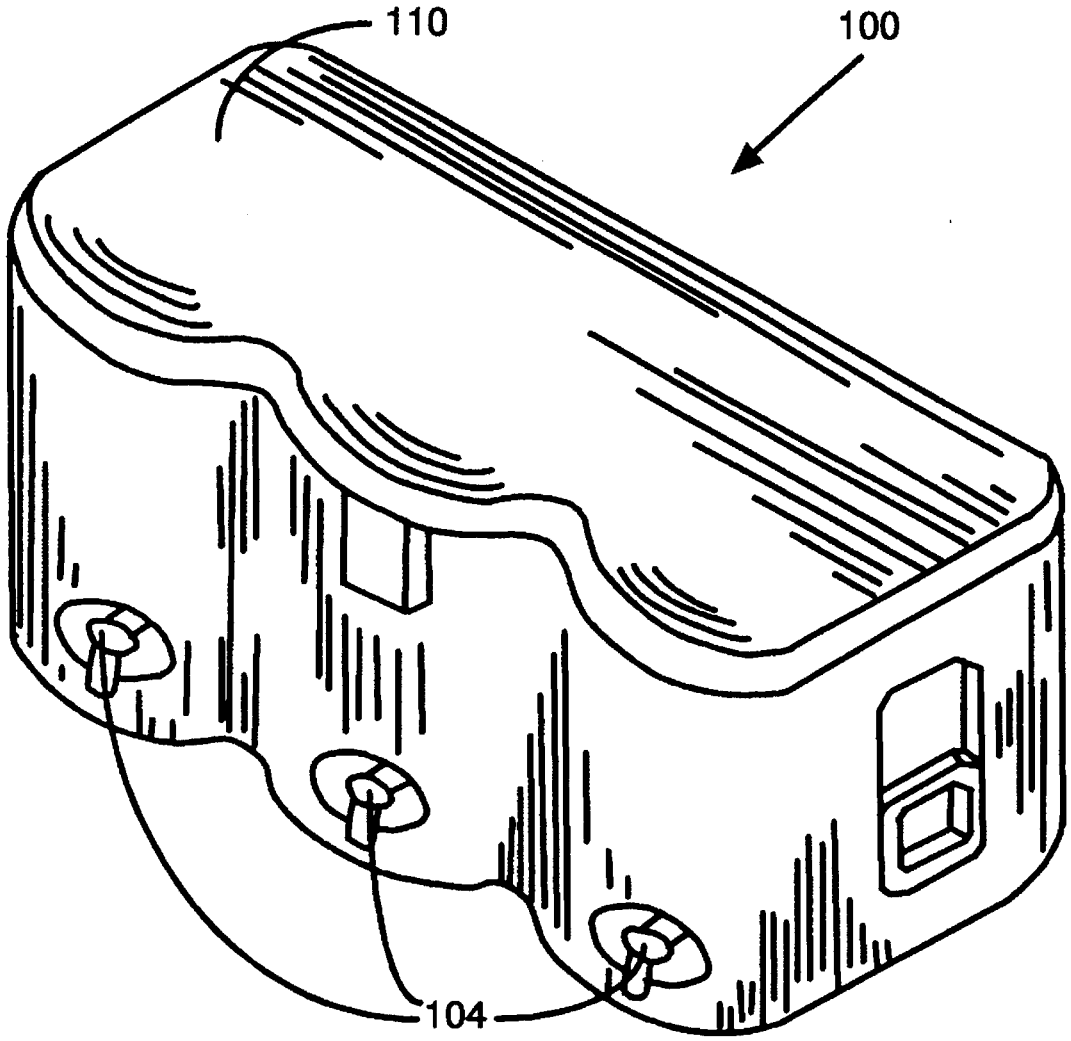
FIG. 2 is a diagram showing a portable container with the dispenser system with the lid in the closed position.

FIG. 2 shows portable container 100 in the closed position. An advantage of the instant invention, as shown in this figure, is that the beverages can be obtained from spigots 104 while the lid 110 of portable container 100 is closed. This allows the food and beverages stored in portable container 100 to remain protected from adverse temperature changes.

Figure 3:
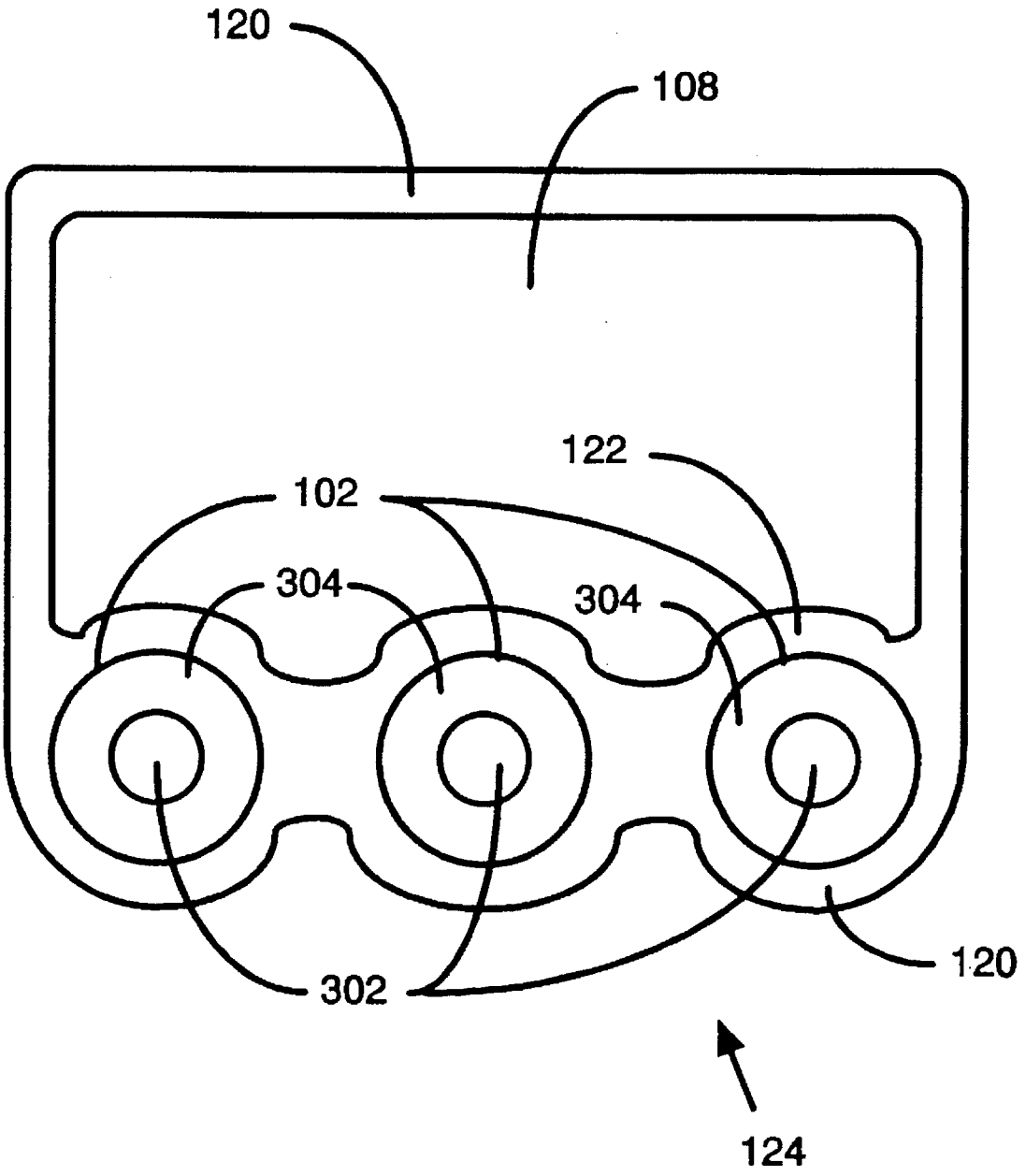
FIG. 3 is a top view of the lower portion of the portable container showing the sleeves and shoulder supports.

FIG. 3 shows a top view of lower container body 124. Perimeter wall 120 forms a portion of sleeves 102, and in addition, defines non-beverage storage area 108. The portion of sleeves 102 which are not formed by perimeter wall 120 are formed by inner wall 122, In the preferred embodiment, the surfaces between the sleeves are indented for providing two optional features. The indentations between sleeves 102 on perimeter wall 120 are envisioned as a way to provide a secure location for a seat belt or other tie down when transporting the portable container 100 in a vehicle. By placing the seat belt such that it is tightened while in the indentation between sleeves 102, seat belt is less apt to slip. The purpose of the indentations on inner wall 122 between sleeves 102 is described below in regard to FIG. 7.

Apertures 302 are shown at the bottom of sleeves 102. Apertures 302 provide an opening for the necks of beverage containers 402 (shown in FIG. 4) to fit through when they are loaded into sleeves 102. Surrounding apertures 302 are shoulder supports 304 (discussed below in regard to FIG. 4).

Figure 4:
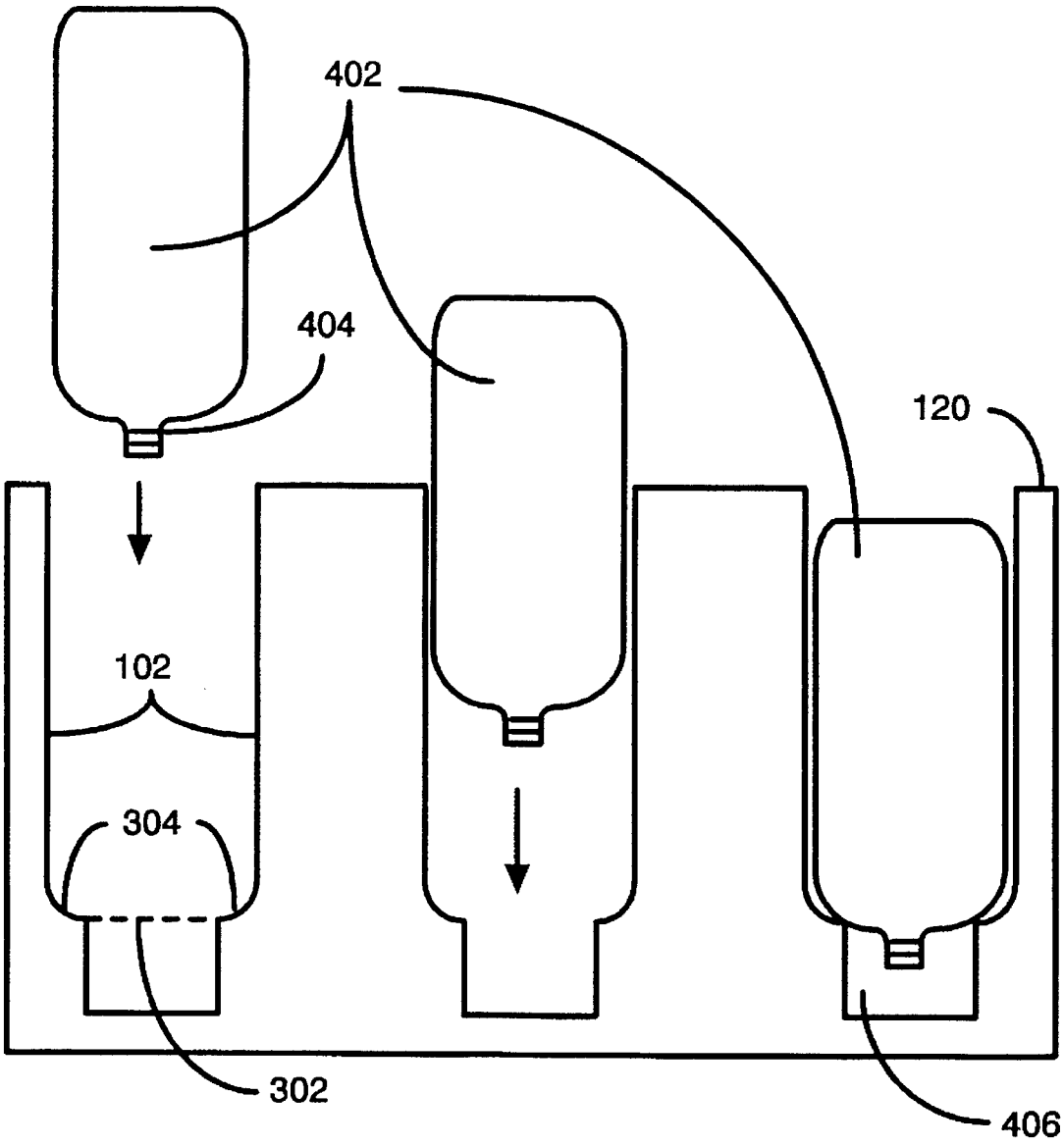
FIG. 4 is a cross sectional side view of the portable container showing the sleeves and shoulder supports.

FIG. 4 shows beverage containers 402 in various stages of insertion into sleeves 102. As can be seen, beverage containers 402 are inverted before loading into sleeves 102. The method of accomplishing this without spilling beverage is discussed more fully below. When a beverage container 402 is fully inserted, the neck 404 is prevented from contacting the bottom of portable container 100 by shoulder supports 304. The purpose of shoulder supports 304 is to ensure that adequate room is provided for beverage conduits 1404 (discussed more fully in regard to FIGS. 14–17).

A principle advantage of this invention, as illustrated in FIG. 4, is that commonly available containers, such as 2 liter plastic soda bottles may be used as beverage containers 402. This allows carbonated beverages to be dispensed from portable container 100 without removing the beverage from its original container.

Figure 5:
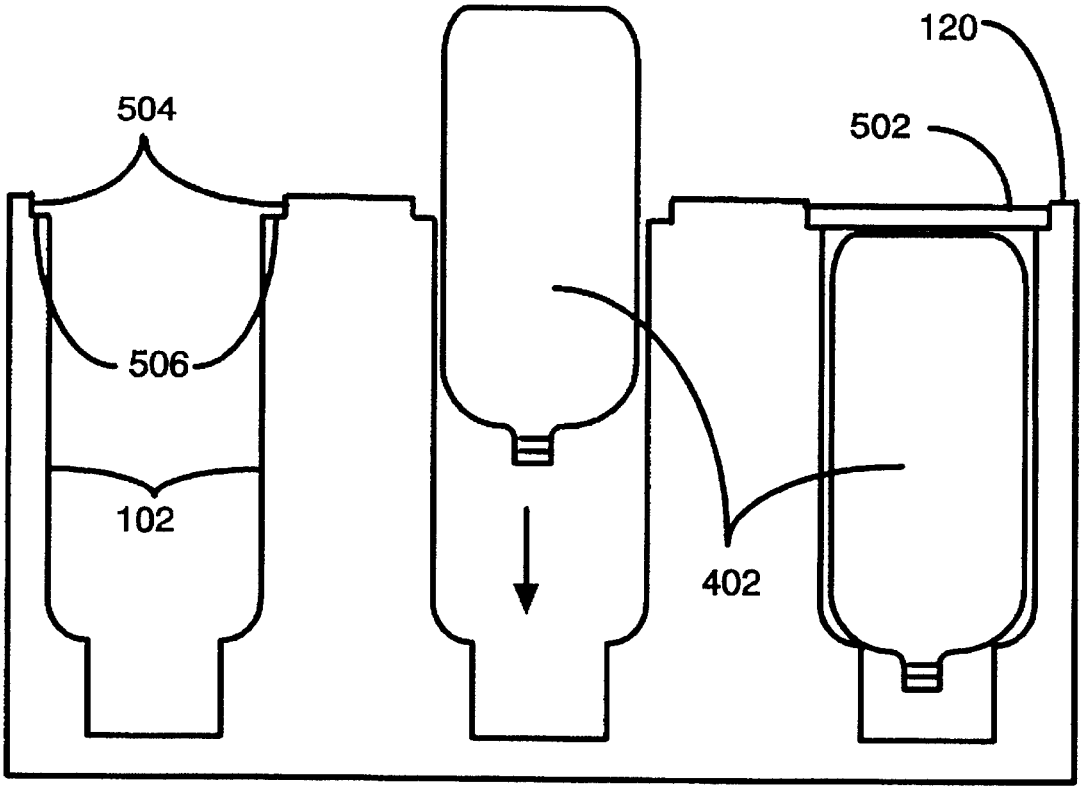
FIG. 5 is a cross sectional side view of the portable container showing the resealable lid.

FIG. 5 shows a side cross sectional view of portable container 100 with resealable lid 502. When resealable lid 502 is secured to the top of sleeve 102, it provides a water tight seal which prevents any spillage if beverage has leaked into the sleeve 102 and the portable container is knocked over. More importantly, it provides a secure method of retaining beverage dispenser 402 in position. In the preferred embodiment, resealable lid 502 is threaded into threads 504 until it comes to rest against rim 506.

Figure 6:
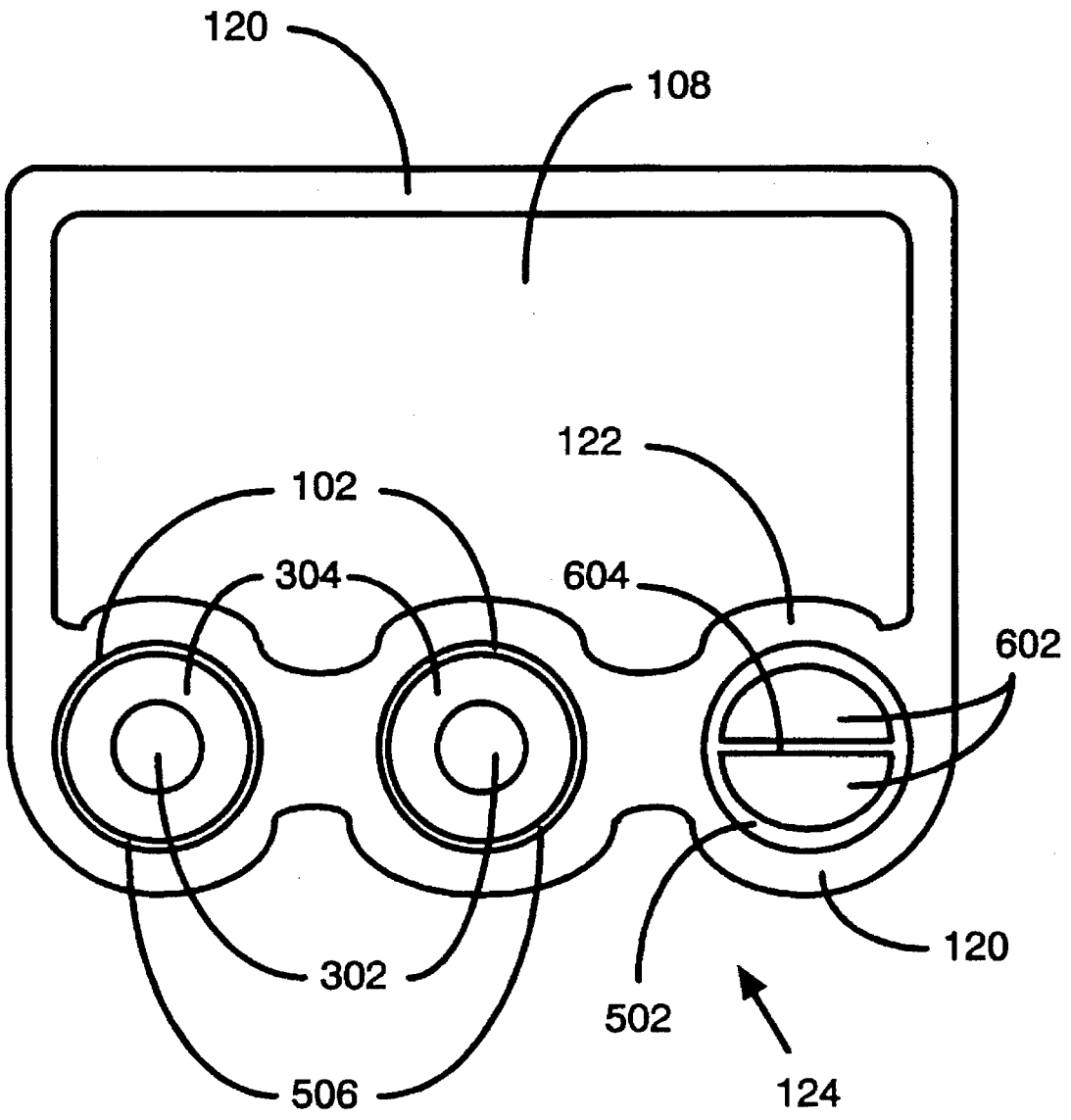
FIG. 6 is a top view of the portable container showing the resealable lid.

FIG. 6 shows a top view of the lower container body 124 with resealable lid 502 and rim 506. The upper surface of resealable lid 502 has indented areas 602 and raised ridge 604. Raised ridge 604 provides an easy method of threading resealable lid 502 into sleeve 102.

Figure 7:
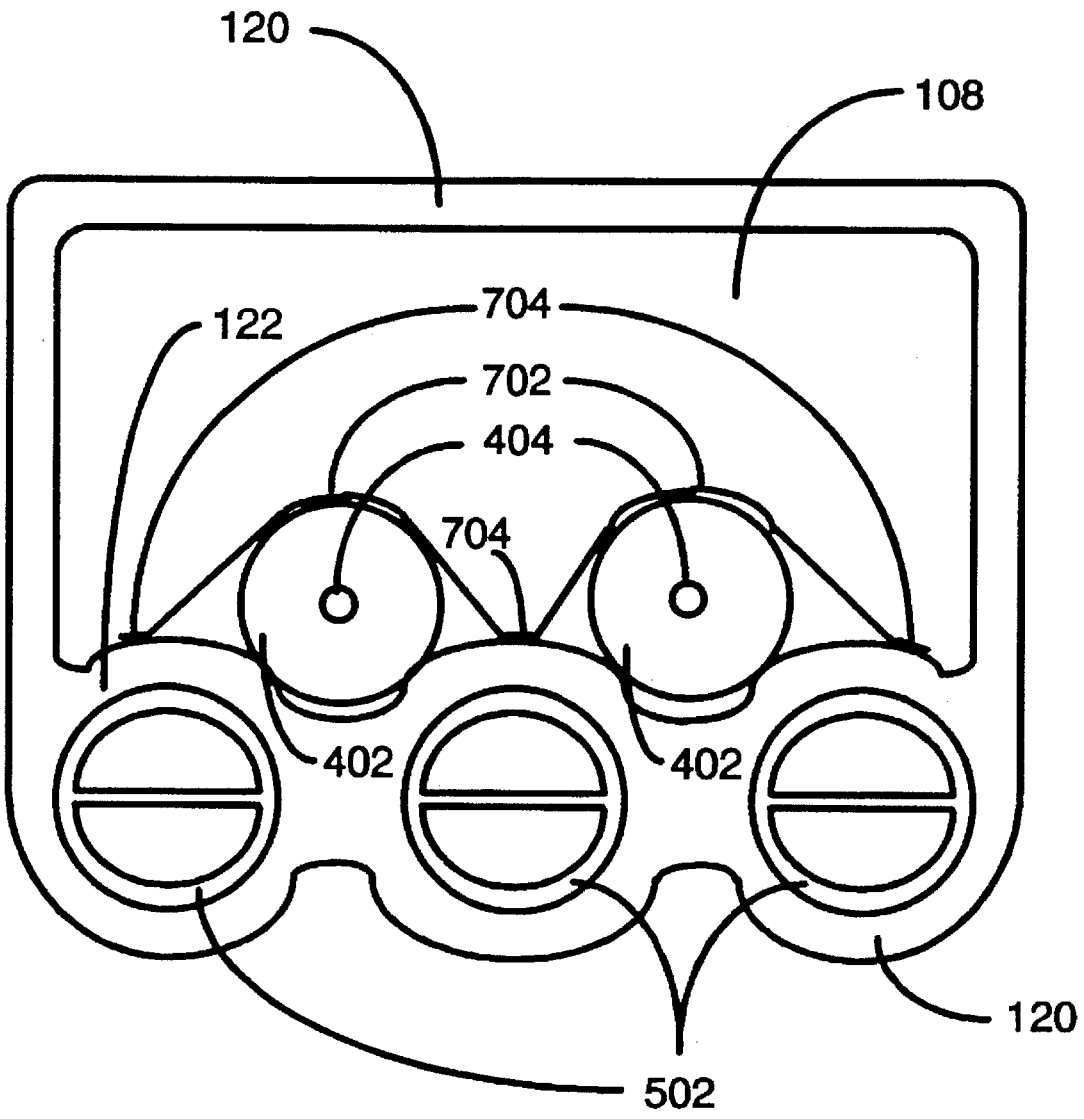
FIG. 7 is a top view of the portable container showing reserve beverage containers and their associated tie downs.

FIG. 7 show an alternative embodiment which includes additional beverage storage. In this embodiment, replacement beverage containers 402 are held in indented areas between the sleeves (mentioned above in the discussion of FIG. 3). By placing the beverage containers 402 in the indented areas and holding them down with straps 702, beverage containers 402 are held safely during transport. In addition, if cooling devices such as blue ice are placed between sleeves 102, then beverage containers 402 will also be kept cooler so that they will be at a more desirable temperature when they replace the beverage containers 402 currently inserted in sleeves 102. Straps 702 can be attached to inner wall 122 by any convenient method, such as hook and loop, snaps, etc.

Figure 8:
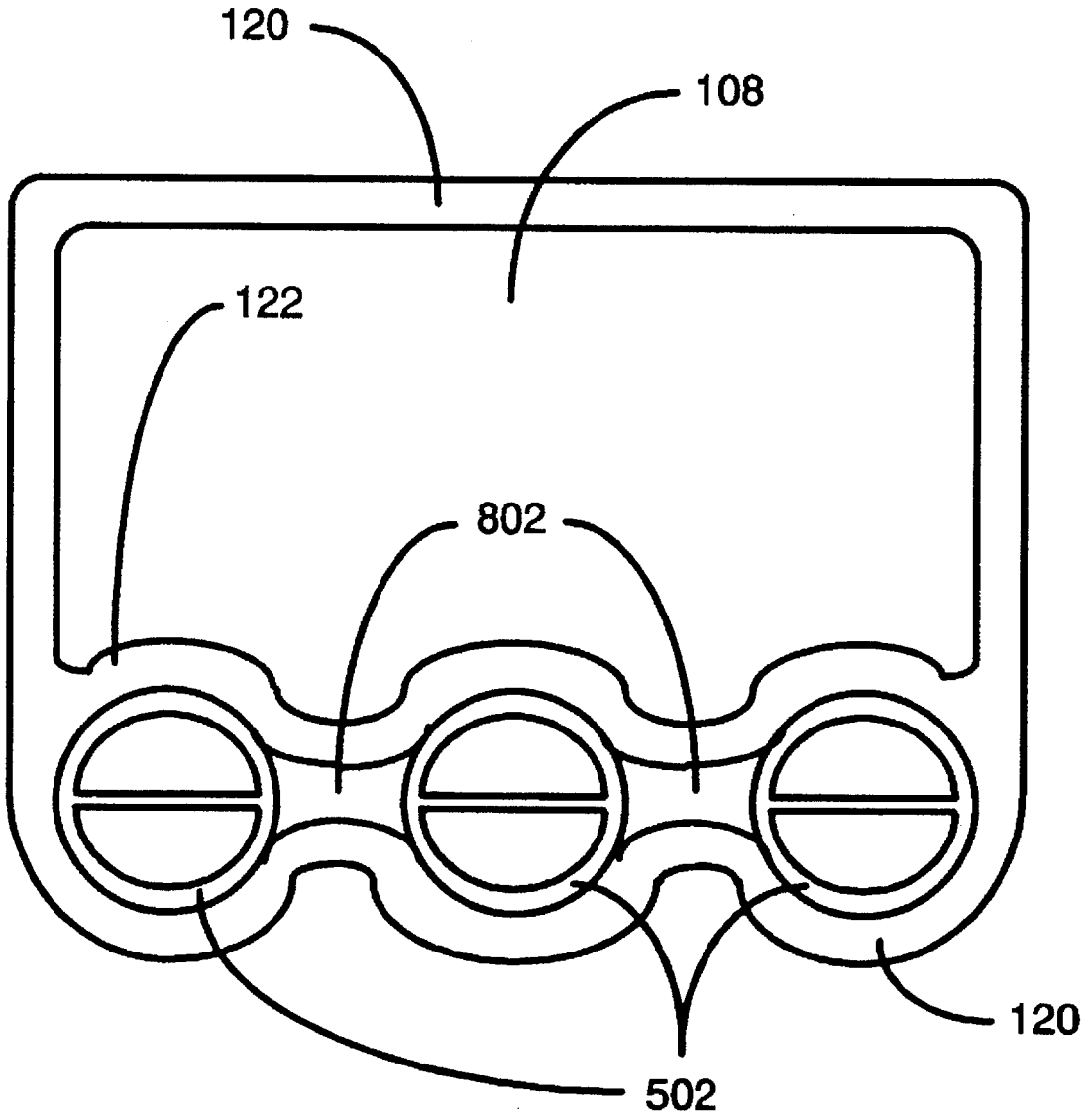
FIG. 8 is a top view of the portable container showing thermal devices located between the beverage sleeves.

FIG. 8 shows an alternative embodiment which uses thermal control devices such as "blue ice" blocks 802 (commonly available refreezable cooling devices). The blue ice blocks 802 are inserted between sleeves 102 to maintain the cool temperature of the beverages. As mentioned above in regard to FIG. 7, the inserts for the blue ice blocks 802 can be formed such that they can also provide cooling for the replacement beverage containers 402.

Figure 9:
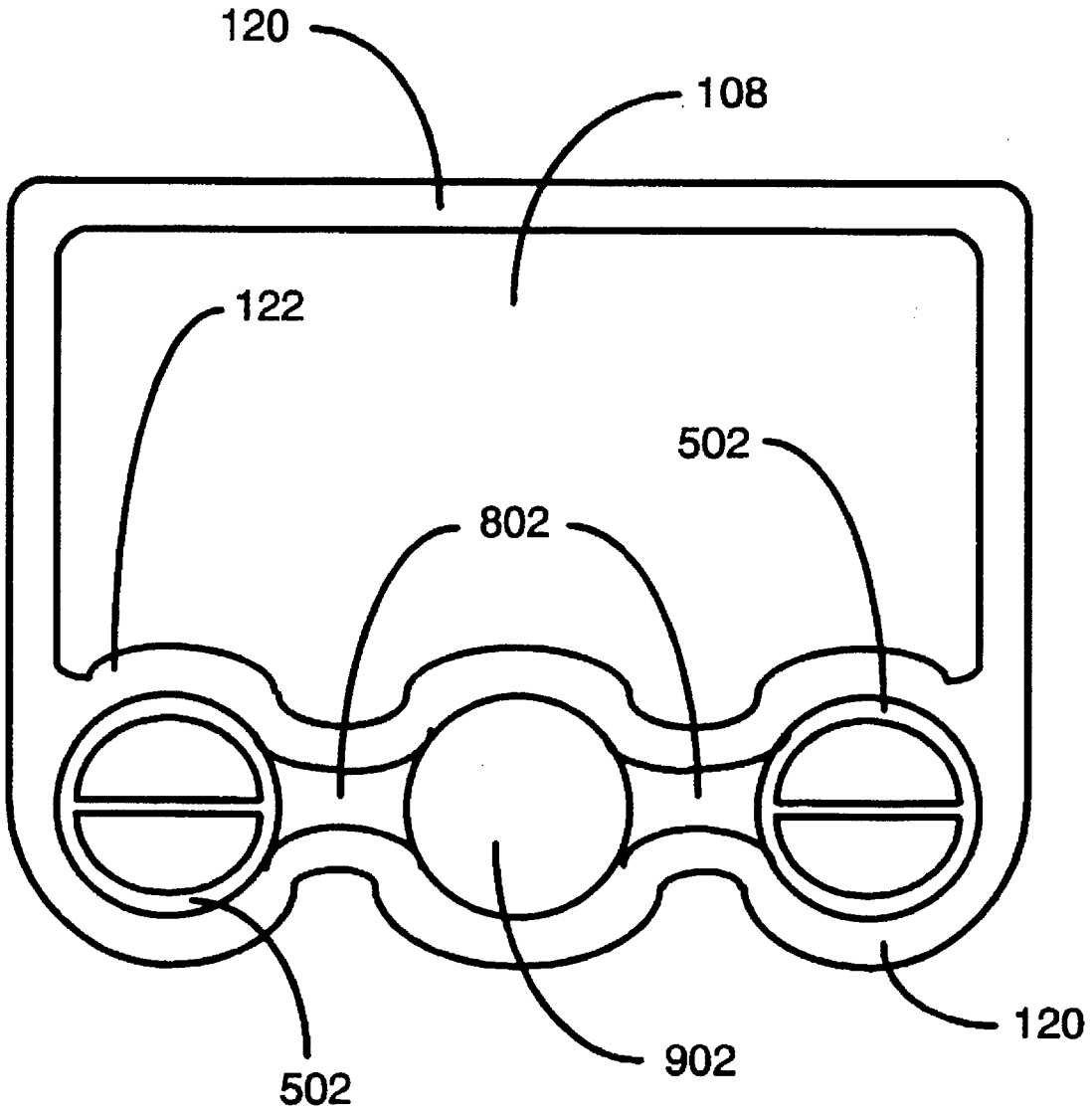
FIG. 9 is a top view of the portable container showing a storage container in the middle sleeve.

FIG. 9 shows another alternative embodiment in which one of the beverage containers 402 is replaced by storage container 902. Storage container 902 may be used to store non-beverage food items, such as soups, salads, etc. In addition, it can also be used to provide safe storage for valuables while using the portable container 100 at locations such as the beach.

Figure 10:
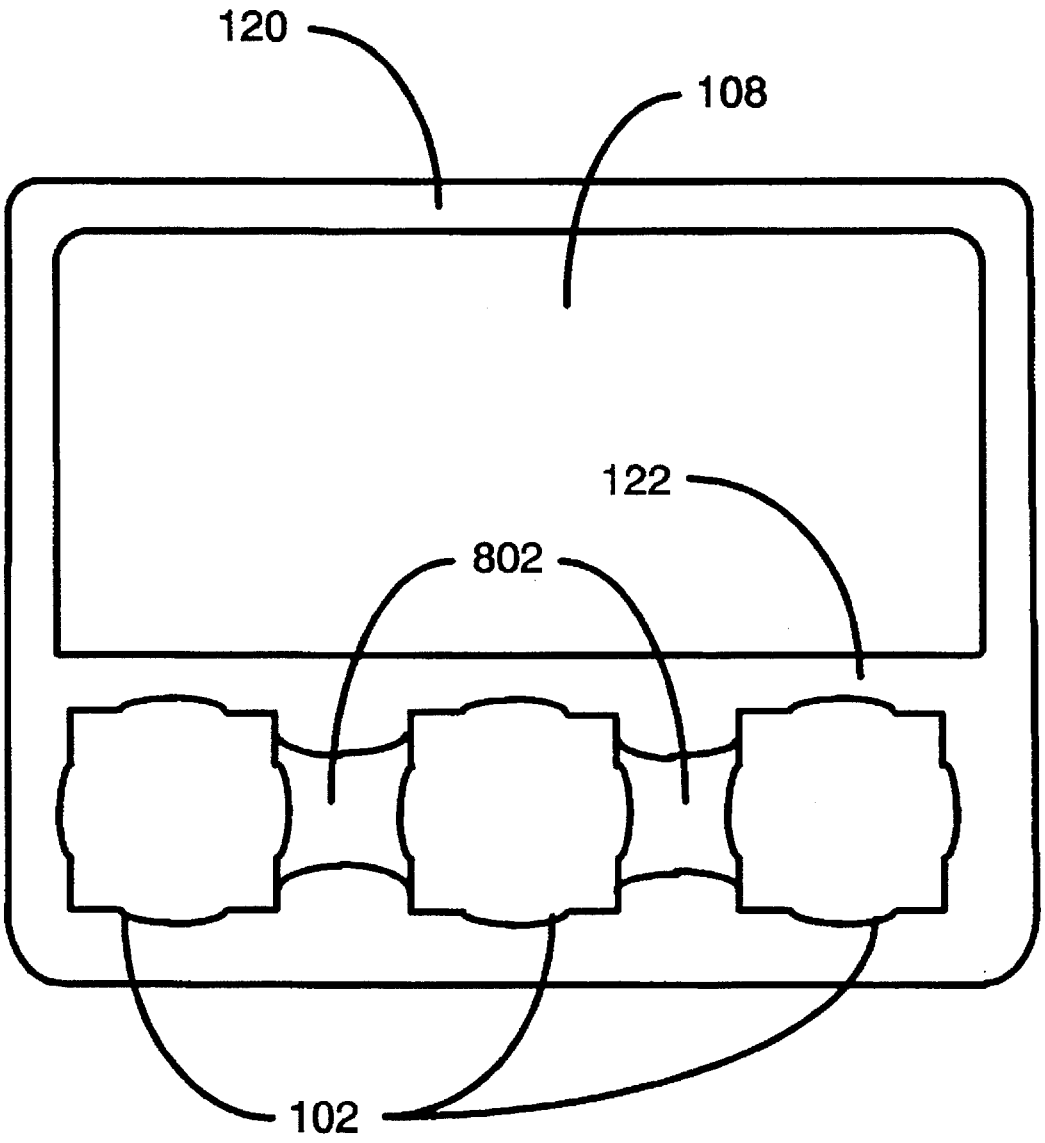
FIG. 10 is a top view of the portable container showing sleeves designed for multiple beverage container shapes.

FIG. 10 shows an alternative embodiment in which sleeves 102 are shaped such that a variety of beverage container 402 shapes may be accommodated. In this embodiment, both square and round beverage containers may be used. In addition, this embodiment illustrates the fact that surfaces of the perimeter wall 120 and inner wall 122 may be flat rather than indented.

Figure 11:
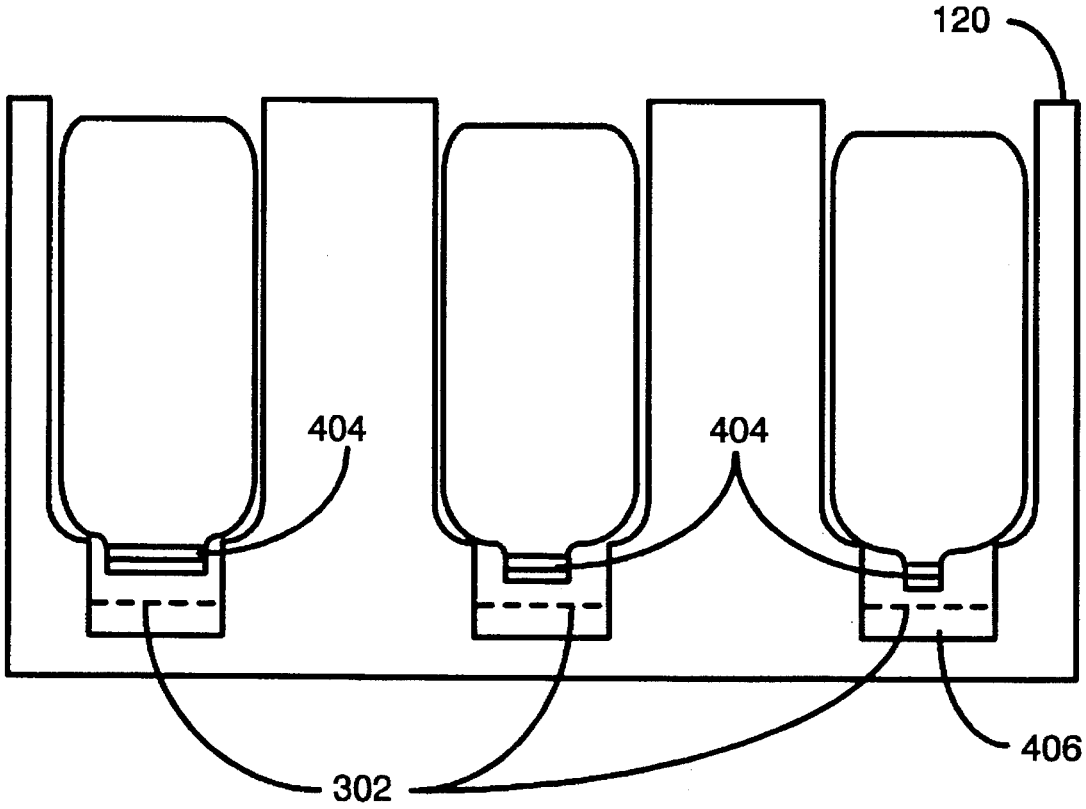
FIG. 11 is a cross sectional view of the portable container showing multiple beverage containers with multiple mouth sizes.

In FIG. 11, each of beverage containers 402 have a different mouth size as shown by the different neck 404 sizes, The width of apertures 302 is designed to accommodate a variety of neck 404 sizes. The exact size of aperture 302 is not critical so long as it provides sufficient room for most intended beverage container neck sizes. In addition, area 406 must be deep enough to provide room for the beverage conduit without restricting beverage flow. The exact amount of room required will vary depending on the type of conduit used, the connection method used, etc.

Figure 12:
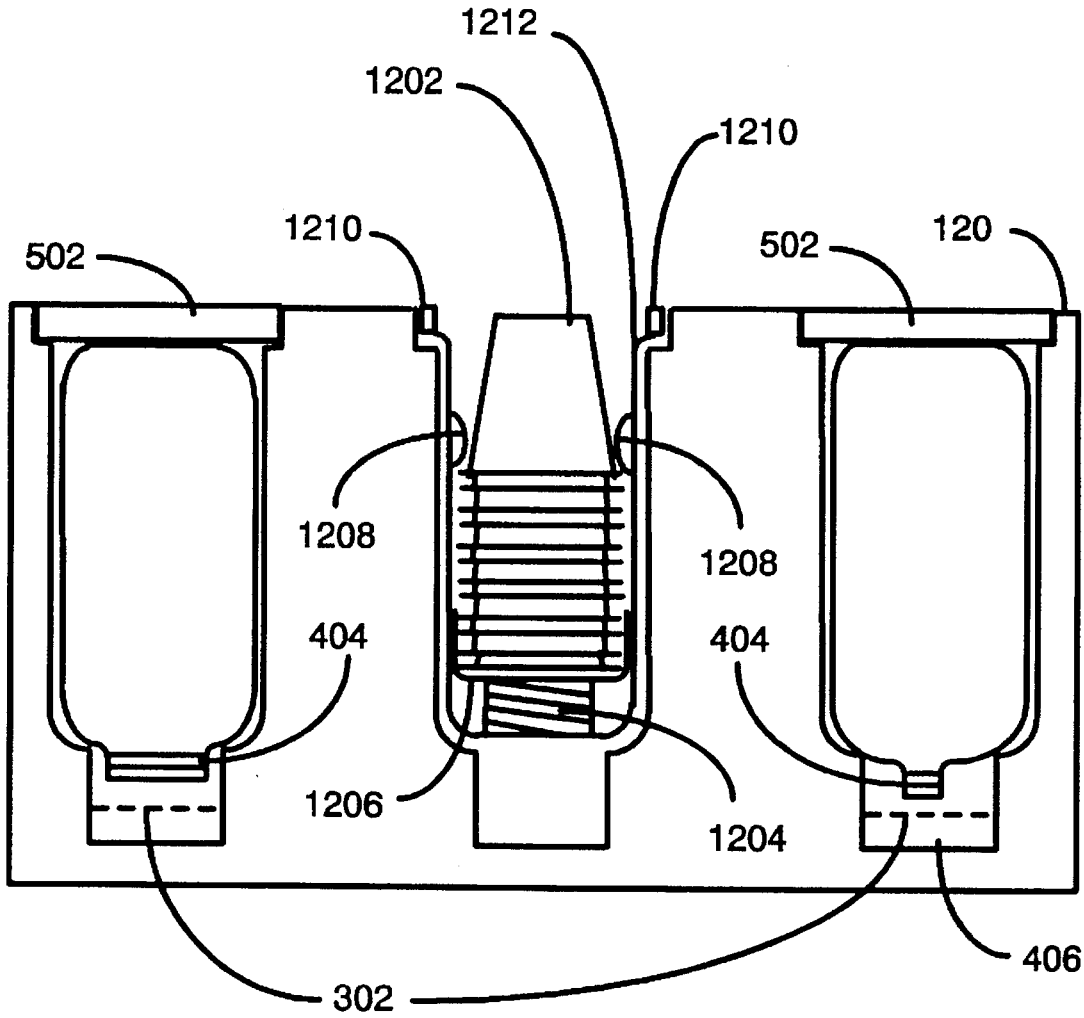
FIG. 12 is a cross sectional view of the portable container showing an optional cup dispenser.

FIG. 12 shows another alternative embodiment in which one of the sleeves 102 is replaced with a cup dispenser. The dispenser is comprised of a dispenser sleeve 1212 which is held in sleeve 102 by retaining ring 1210. Cups 1202 rest on shelf 1206 which is pushed up by spring 1204. Cups 1202 are held in the dispenser by springs 1208. This embodiment envisions a removable cup dispenser. However, those skilled in the art will recognize that a permanent dispenser can also be used.

Figure 13:
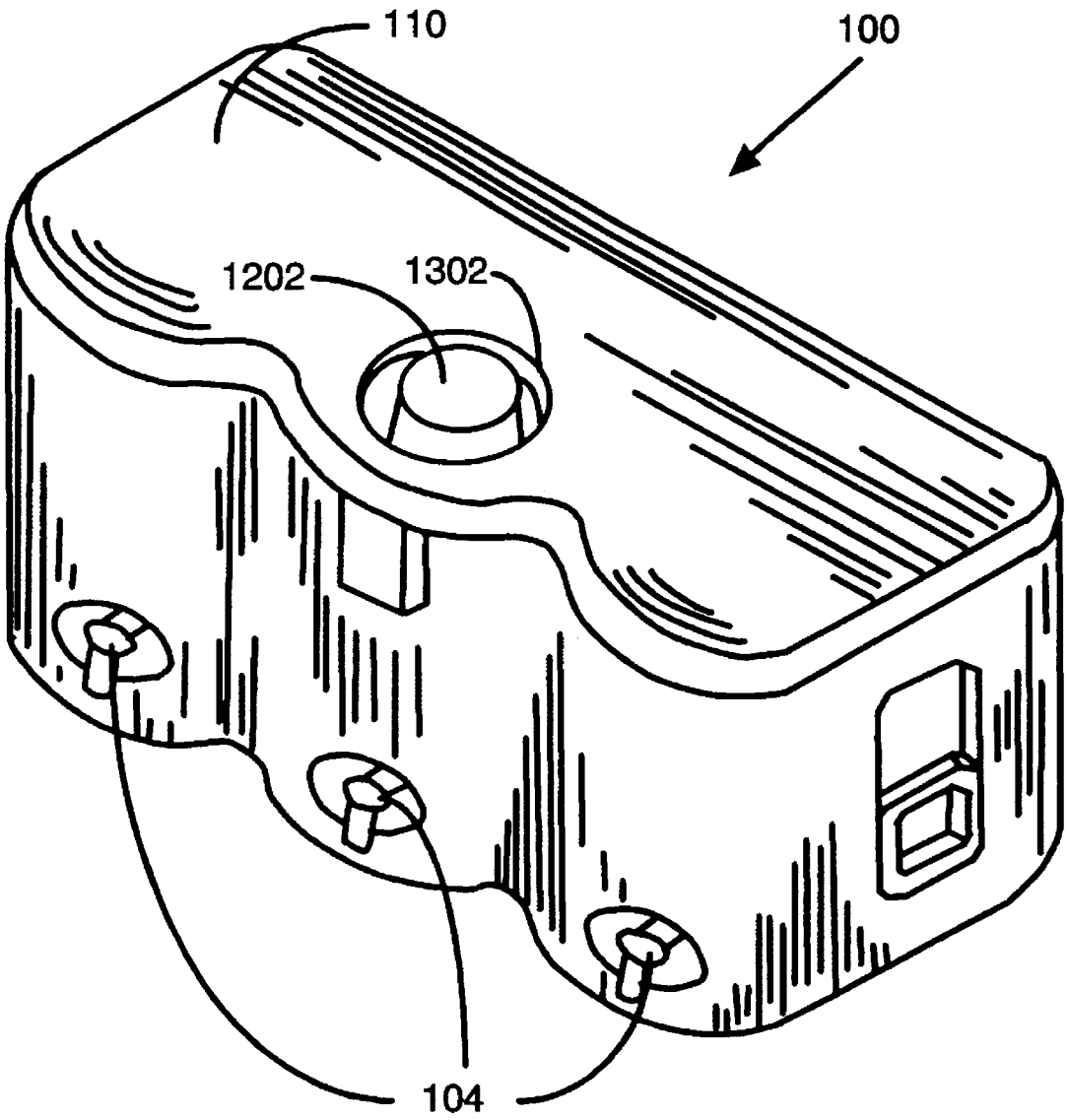
FIG. 13 is a perspective view of the portable container showing an aperture in the lid to accommodate the optional cup dispenser.

FIG. 13 shows a perspective view of portable container 100 with the cup dispenser discussed above in regard to FIG. 12. In this view, the cups 1202 are shown protruding from an aperture 1302. A removable lid insert (not shown) can easily be made to close aperture 1302 when the cup dispenser is not being used. In an embodiment using a removable cup dispenser, the middle spigot 104 would remain so that the middle sleeve could be used for beverage dispensing when desired. Of course, if a permanent cup dispenser were installed, the middle spigot 104 would not be present.

Figure 14:
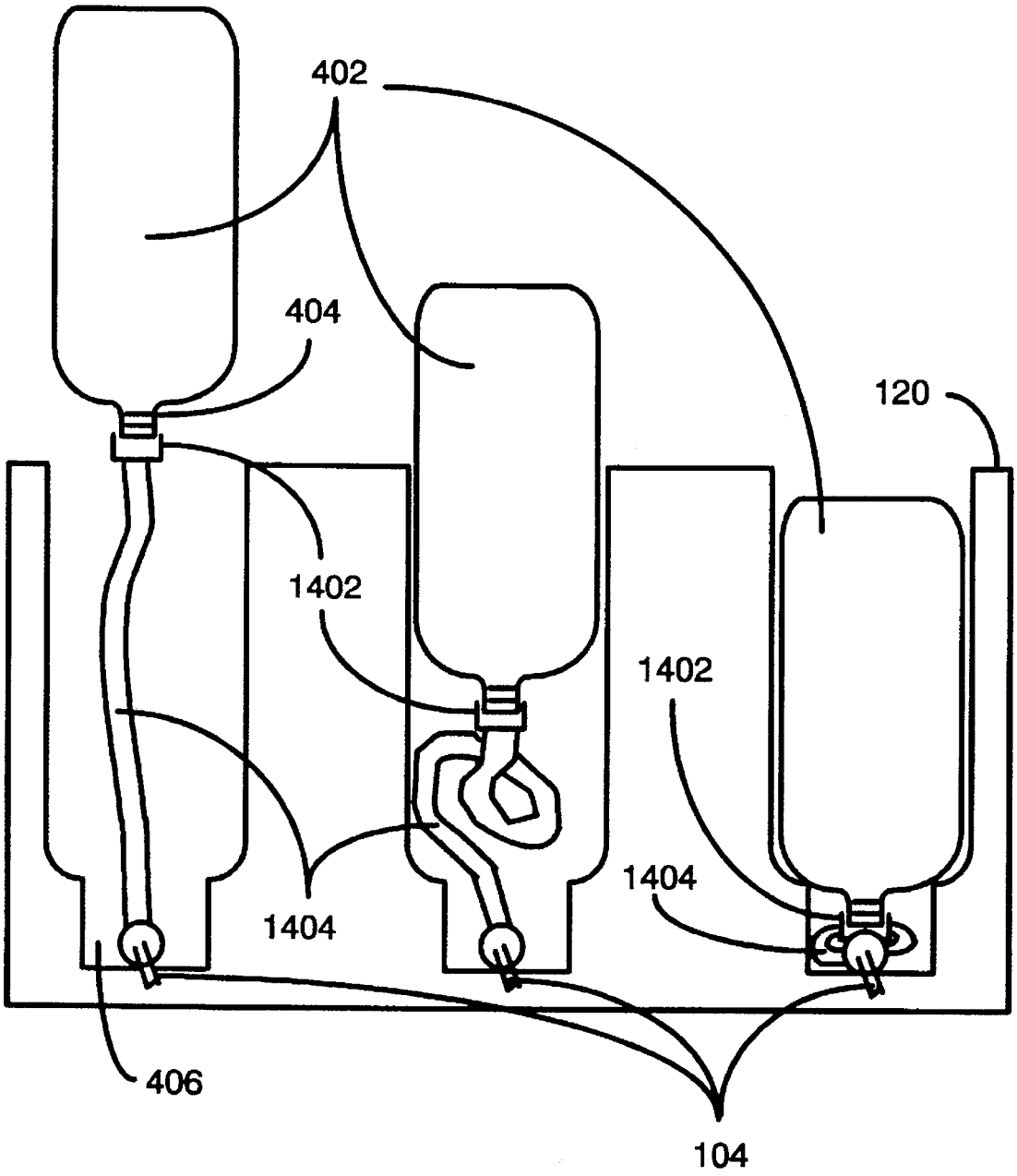
FIG. 14 is a cross sectional view of the portable container showing a method of connecting the beverage container to the portable container.

FIG. 14 shows a preferred embodiment of the invention in which a beverage conduit 1404 has an extended length which allows connector 1402 to be attached to neck 404 of beverage container 402 while beverage container 402 is in an upright position and outside of portable container 100. Beverage conduit 1404 is connected at its other end to spigot 104. After beverage conduit 1404 is attached to beverage container 402, beverage container 402 is inverted and slid into sleeve 102. As can be seen from the position of the beverage containers 402 in FIG. 14, conduit 1404 coils as beverage container 402 enters sleeve 102. Sufficient room must be available in the area below the sleeve 102 to avoid crimping of the beverage conduit 1404.

Figure 15:
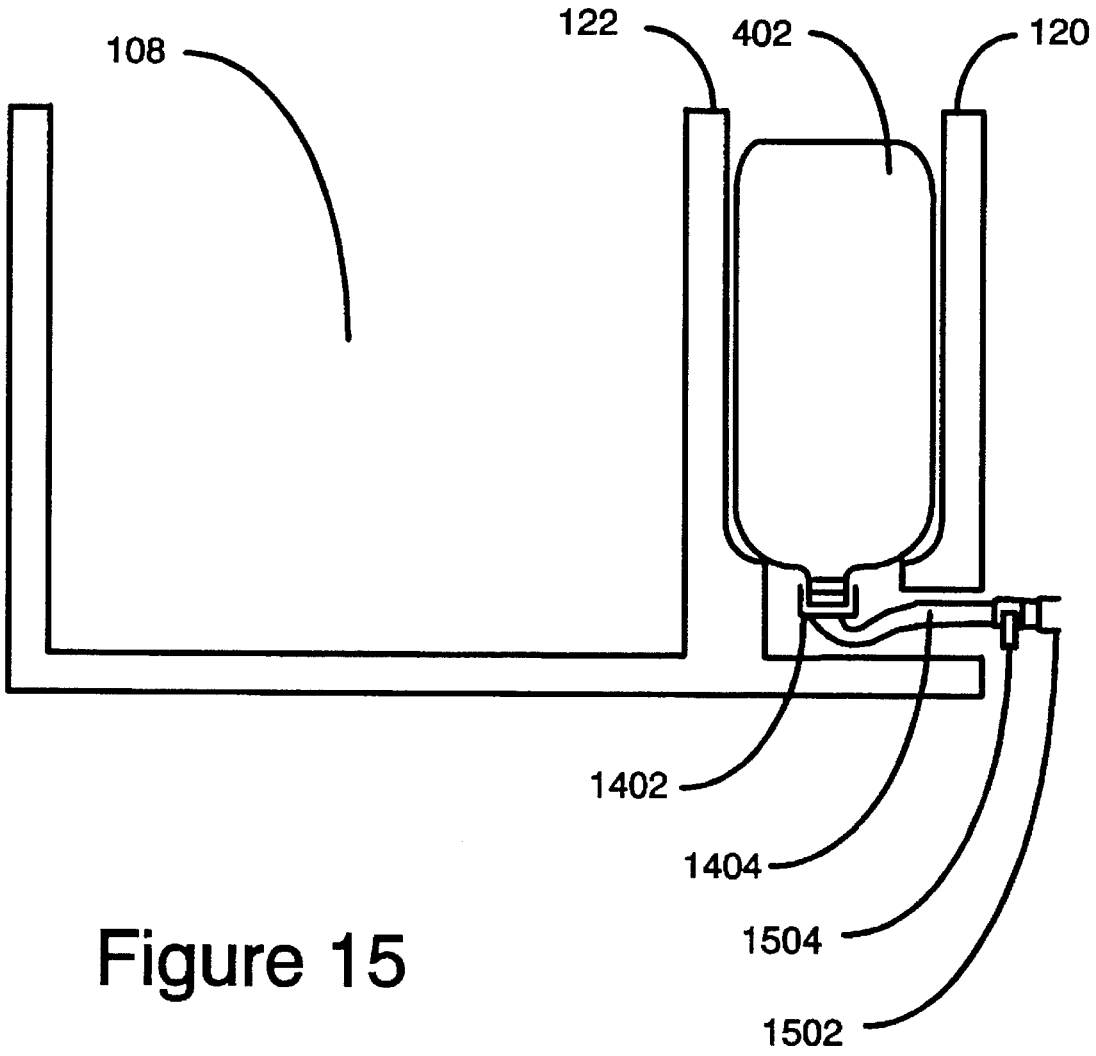
FIG. 15 is a cross sectional side view of the portable container showing the first step of an alternative method of connecting the beverage container to the portable container.

FIG. 15 shows the first step of an alternative preferred embodiment in which a shorter beverage conduit 1404 is used. Beverage conduit 1404 is attached to beverage container 402 prior to attachment to spigot 104. After it is attached to beverage container 402, stopcock 1504 is closed to prevent beverage spillage while beverage container 402 is inverted and inserted into sleeve 102. Connector 1502 is fed through the spigot aperture as the beverage container 402 is loaded into sleeve 102.

Figure 16:
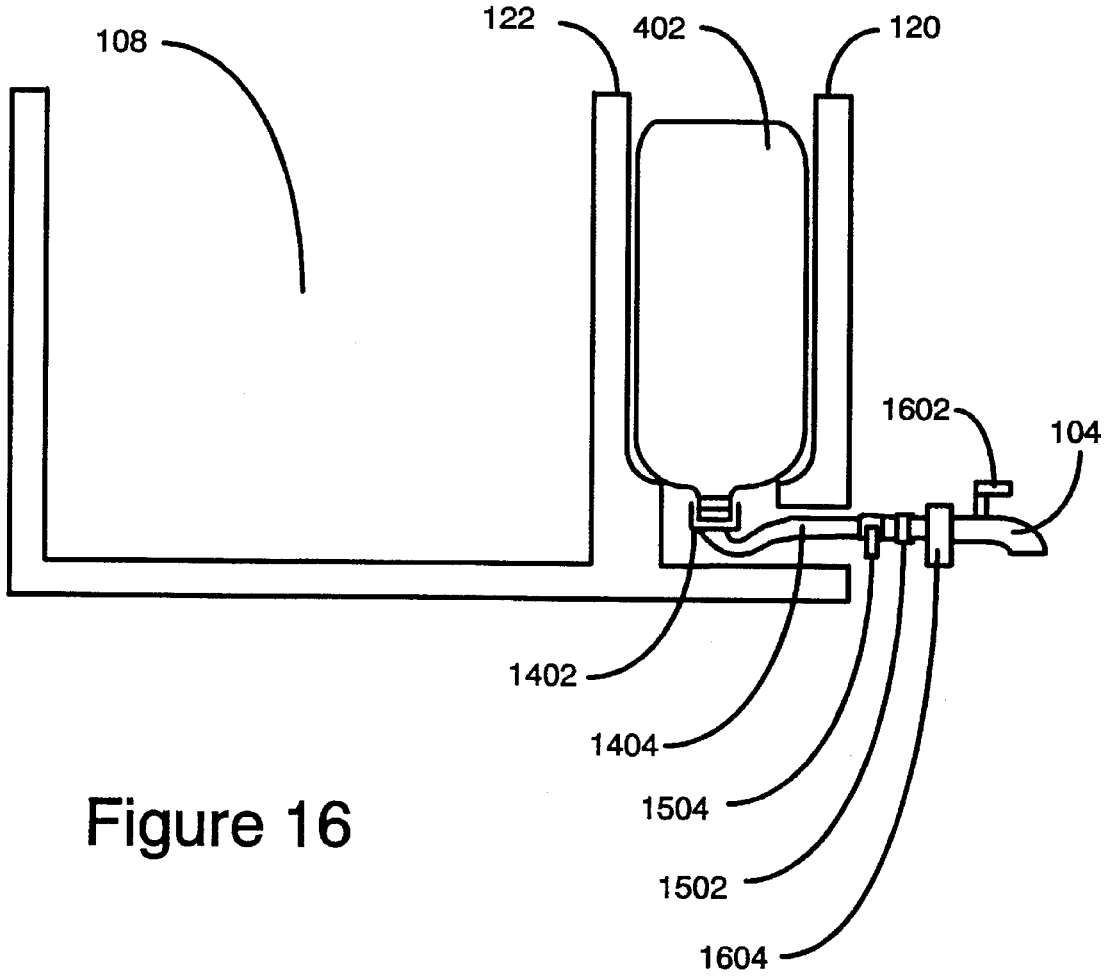
FIG. 16 is a cross sectional side view of the portable container showing the second step of an alternative method of connecting the beverage container to the portable container.

FIG. 16 shows the next step of this embodiment. After the connector 1502 is fed through the spigot 104 aperture, it is attached to spigot 104. At this time, both stopcock 1504 and spigot valve 1602 are closed.

Figure 17:
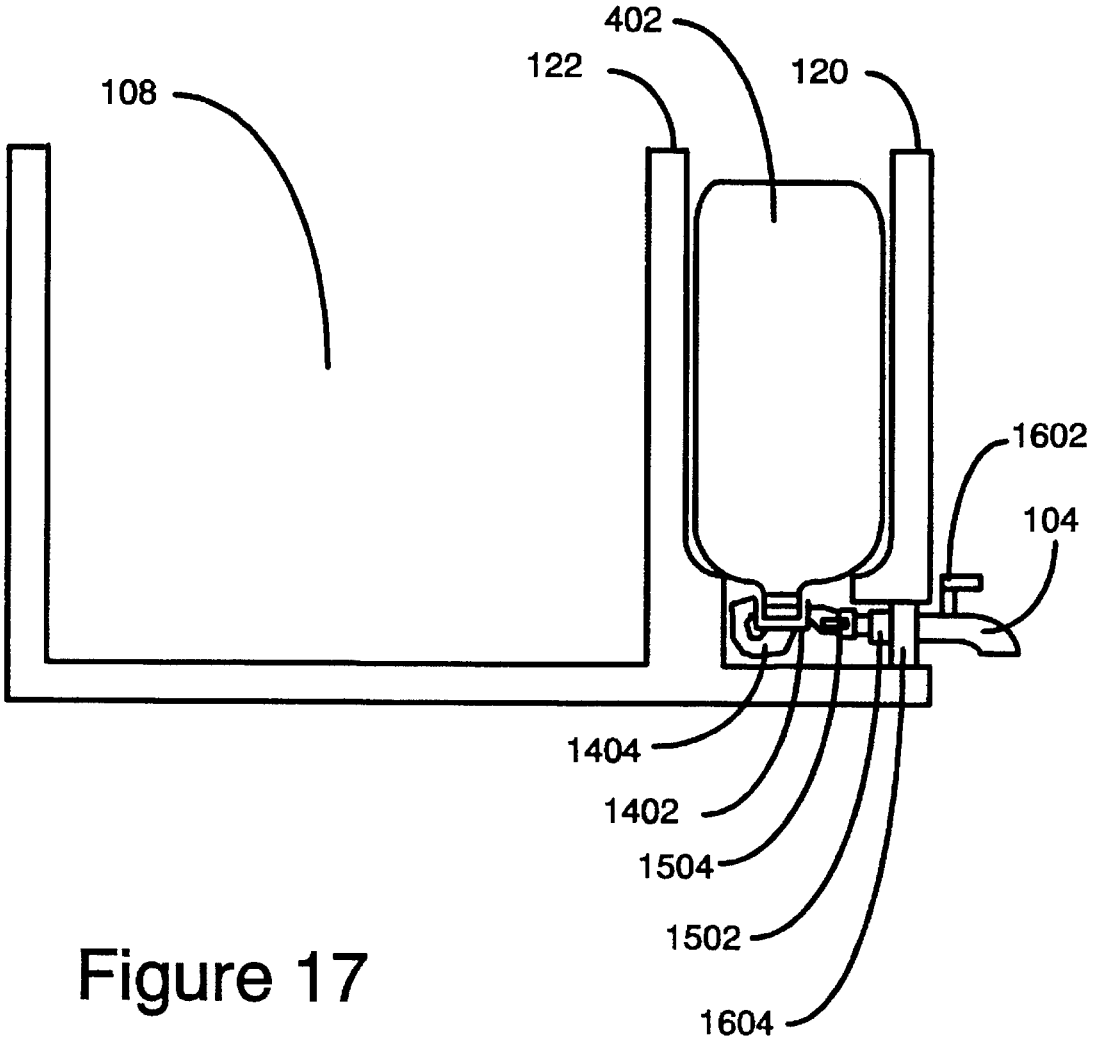
FIG. 17 is a cross sectional side view of the portable container showing the third step of an alternative method of connecting the beverage container to the portable container.

FIG. 17 shows the next step of this embodiment. Stopcock 1504 is moved to the open position. Then beverage conduit 1404 and spigot 104 are slid into the spigot aperture such that removable spigot wall section 1604 is securely fit into perimeter wall 120. Removable spigot wall section 1604 can be attached by a variety of methods. Any suitable method of securing this component is satisfactory so long as it can be removed when the beverage container 402 must be replaced. In the preferred embodiment, removable spigot wall section 1604 will form a watertight seal with perimeter wall 120. Methods of attaching inserts such as the foregoing are well known in the art.

Figure 18:
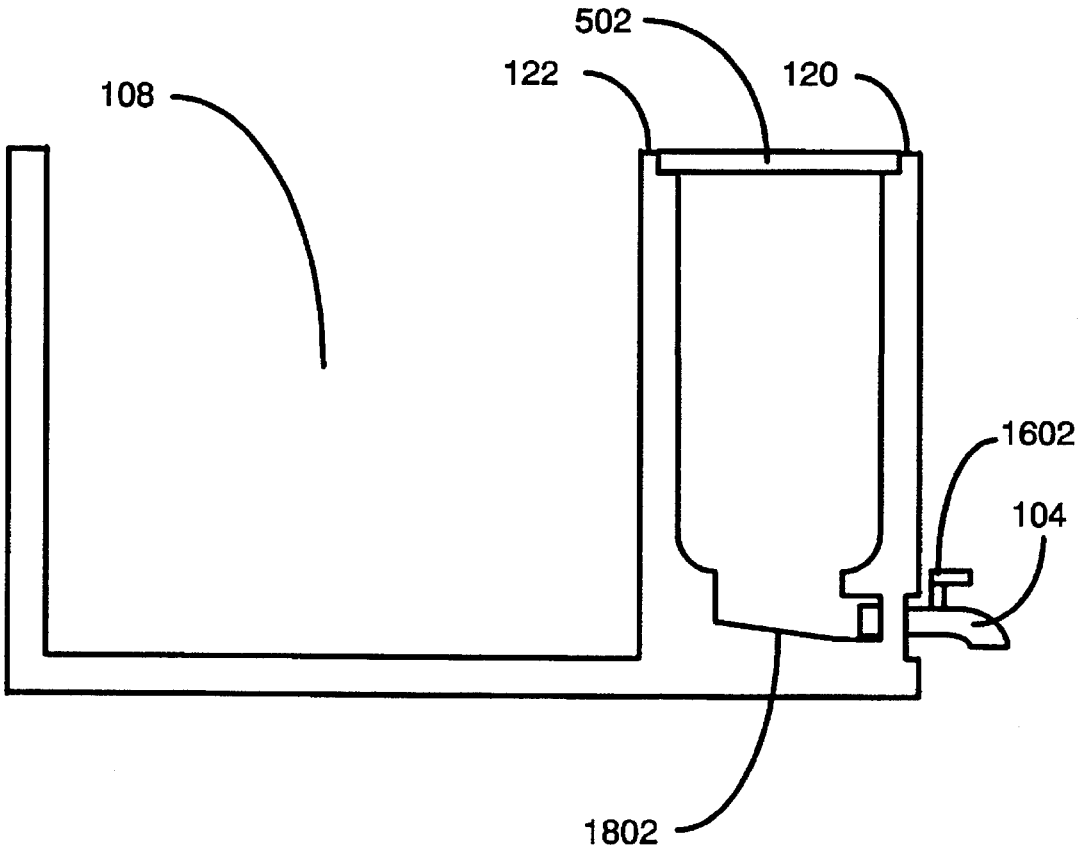
FIG. 18 is a cross sectional side view of the portable container showing a reservoir used in place of the beverage container.

FIG. 18 shows another alternative embodiment of the invention in which the beverage containers are not used. In this embodiment, the sleeve 102 forms a reservoir. Spigot 104 is fed directly from the reservoir. Reservoir floor 1802 is sloped to direct beverage flow to spigot 104. Resealable lid 502 prevents any spillage from the top of the reservoir. This embodiment is useful for non-carbonated beverages, such as iced tea.

Figure 19:
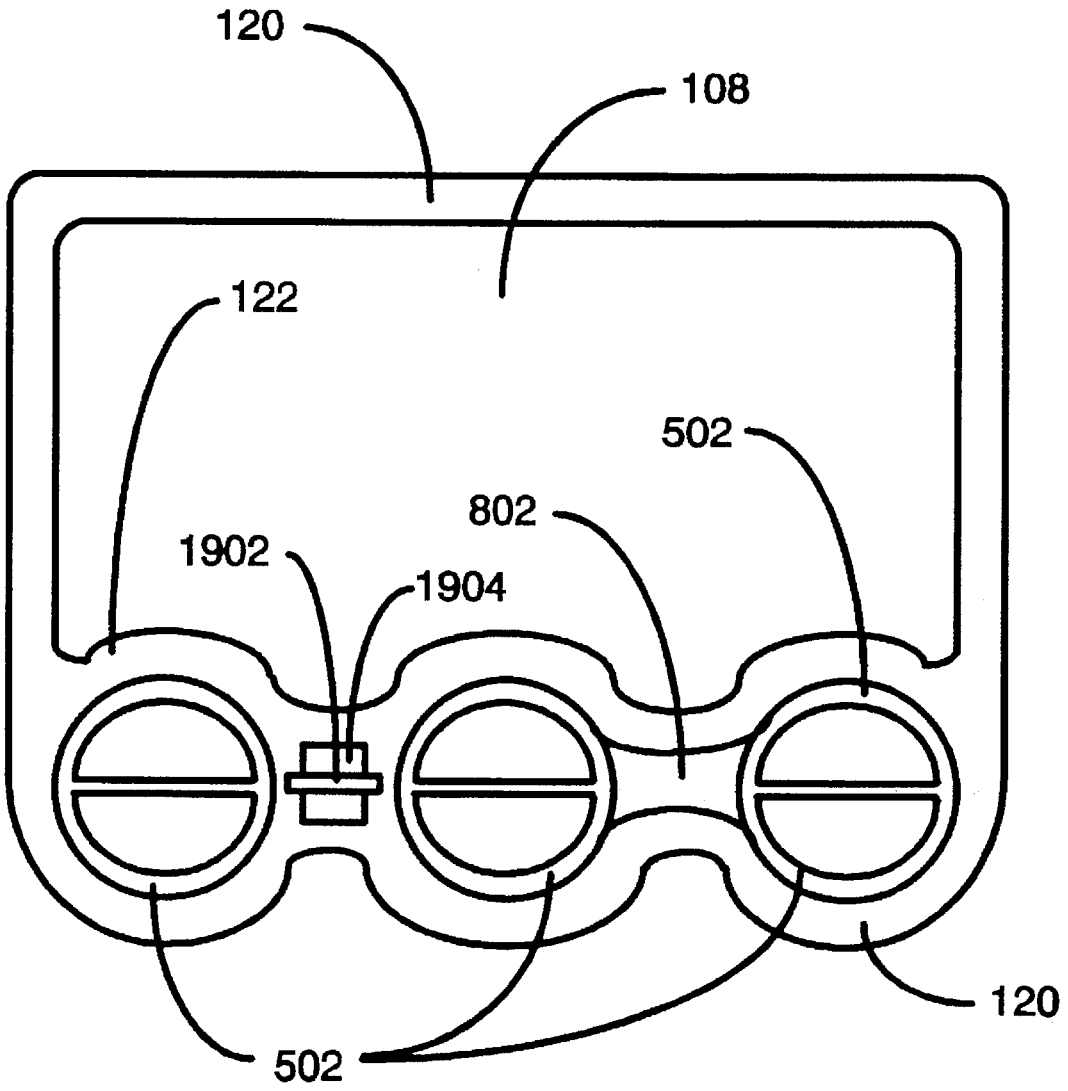
FIG. 19 is a top view of the portable container showing an integral pump for providing air pressure to the reservoir.

FIG. 19 shows an alternative embodiment to that discussed in regard to FIG. 18. This embodiment includes an integrated pump 1904. Pump 1904 may be operated by handle 1902 to increase the air pressure in the reservoir. By maintaining a higher air pressure in the reservoir, beverage flow rate is improved.

Figure 20:
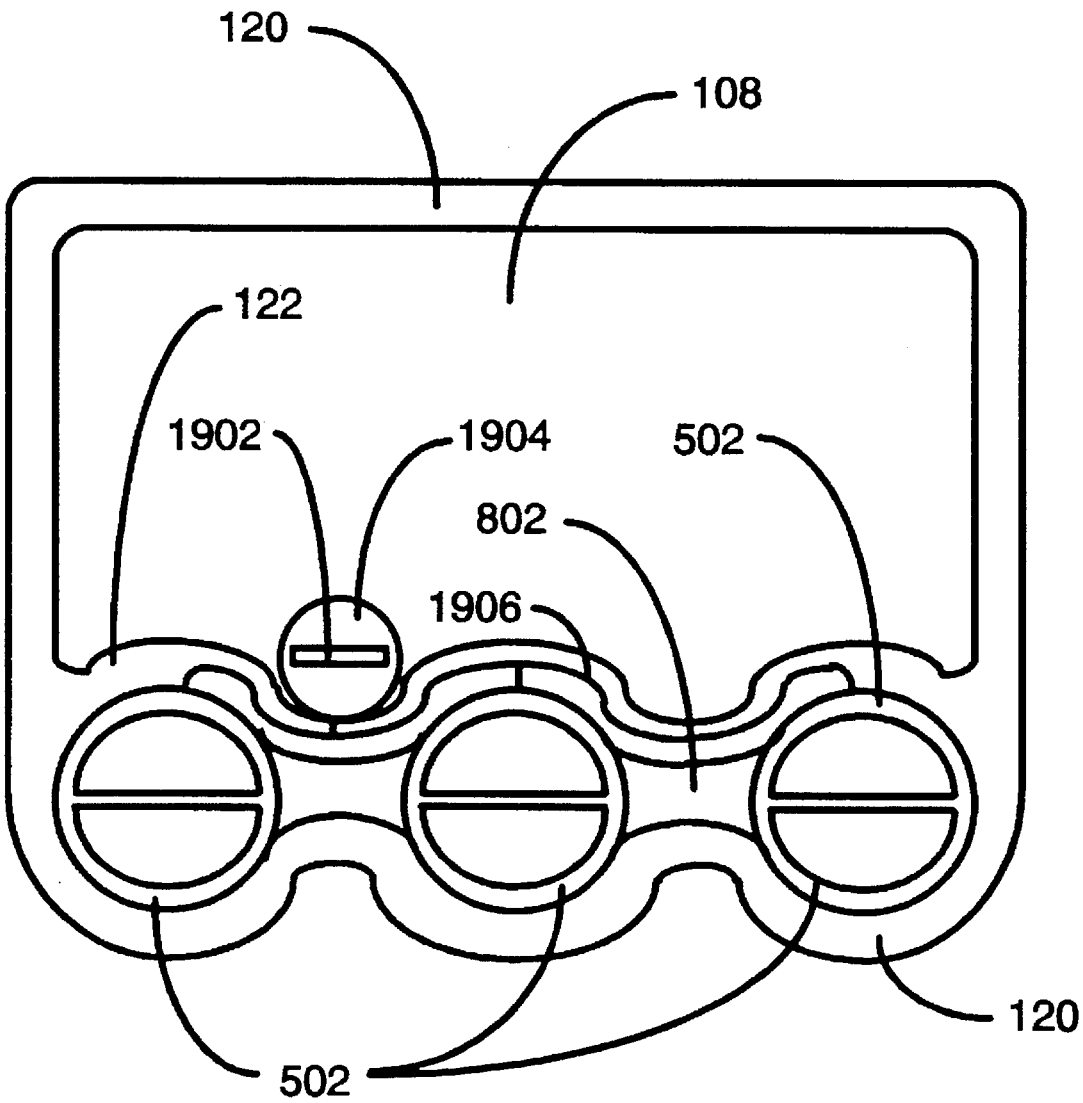
FIG. 20 is a top view of the portable container showing an external pump for providing air pressure to the reservoir.

FIG. 20 shows an alternative embodiment to that discussed in regard to FIG. 19. In this embodiment, an external pump 1904 is operated by handle 1902. Individual pressure lines 1906 feed independent reservoirs.

Figure 21:
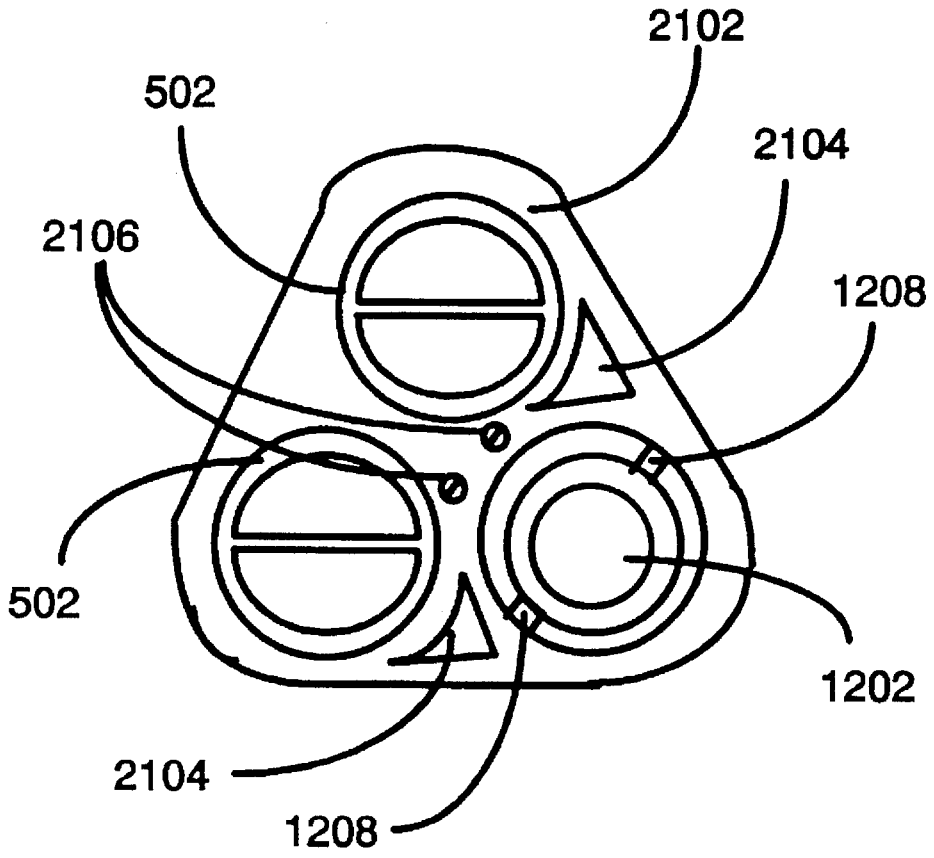
FIG. 21 is a top view of a beverage only alternative embodiment of the portable container showing two beverage container sleeves and a cup dispenser.

FIG. 21 shows another alternative embodiment. In this embodiment, only beverages are provided with no food storage. This figure shows a top view of portable container 100 with two sleeves indicated by resealable lids 502. An optional cup dispenser is indicated by cups 1202, and cup springs 1208. Thermal control 2104 (blue ice slots) provide separate cooling capability for each sleeve 102. Handle attachment connectors 2106 are provided for removable handles (not shown).

Figure 22:
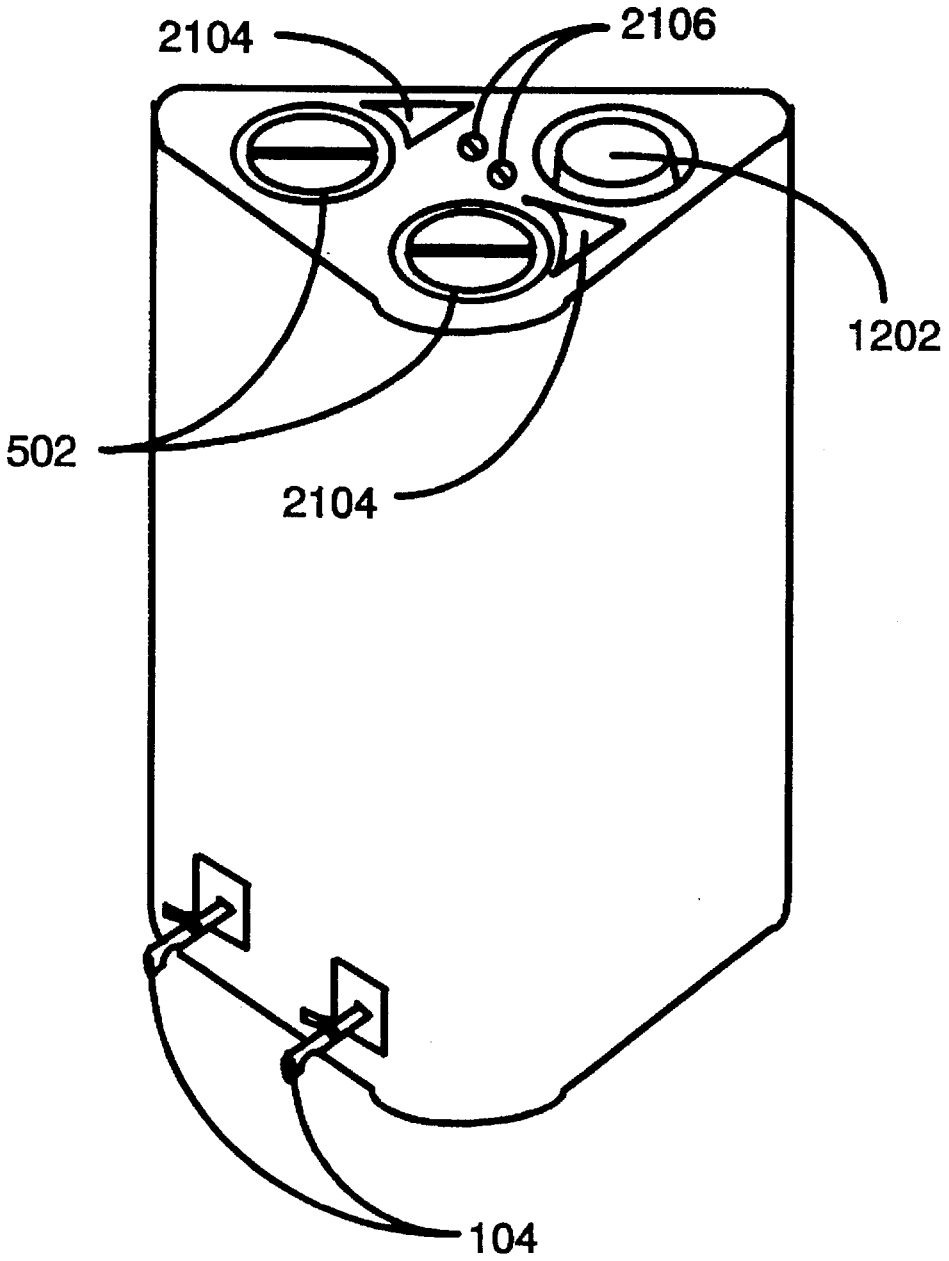
FIG. 22 is a perspective view of a beverage only alternative embodiment of the portable container showing two beverage container sleeves and a cup dispenser.

FIG. 22 is a perspective view of the embodiment discussed in FIG. 21. Spigots 104 are shown at the base of the device. The same connection methods discussed above can be used for this embodiment.

Figure 23:
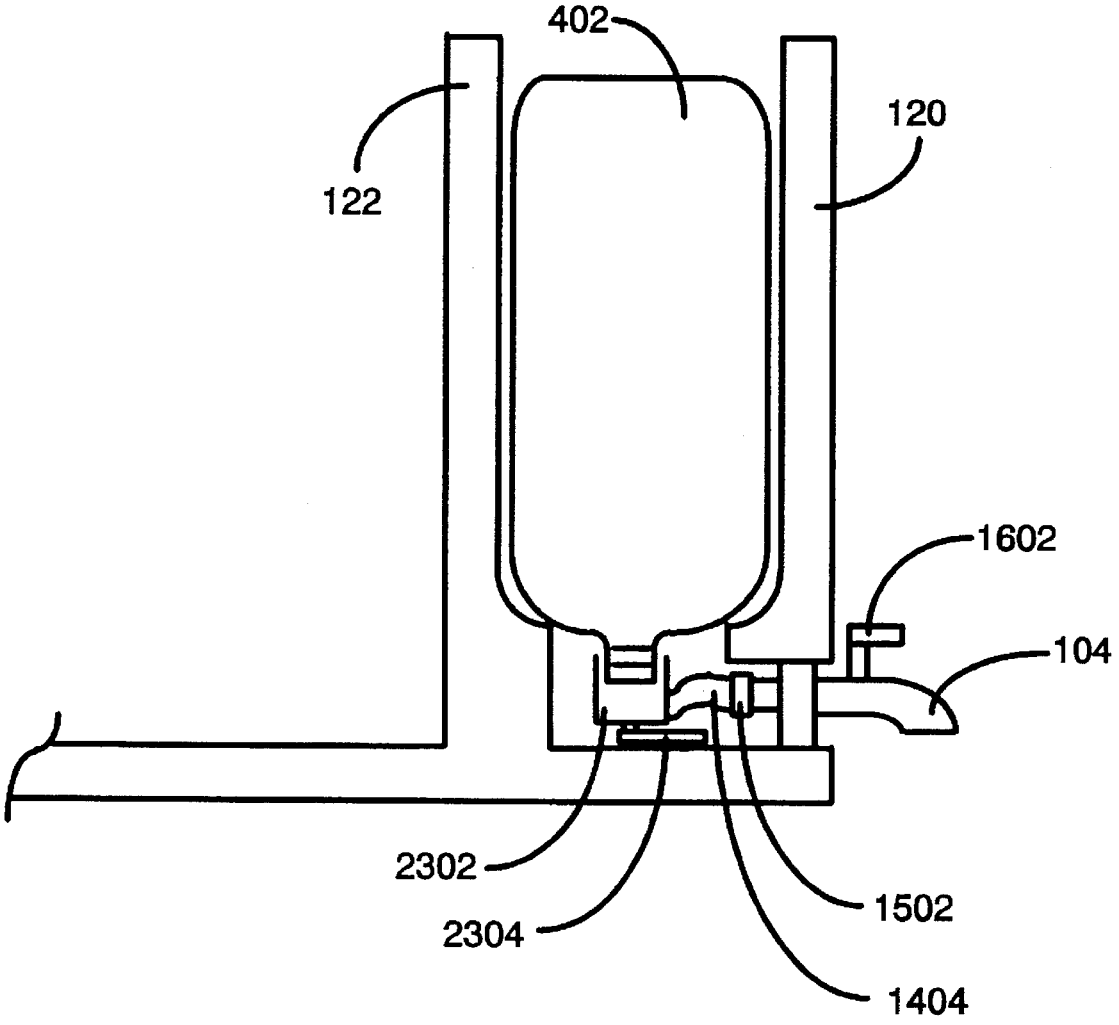
FIG. 23 is an alternative embodiment showing a quick disconnect beverage container connector.

FIG. 23 shows an alternative method of connecting the bottle to the conduit using a quick disconnect connector 2302. Quick disconnect levers are well known in the art and are commonly used on a variety of devices, such as bicycle pumps, etc. In this method, the beverage container 402 is held upright with the cap (not shown) removed. A quick disconnect connector 2302 is placed on the bottle neck and the close/release lever 2304 is placed in the closed position (as shown). Beverage container 402 is then inverted and slid into position. For ease of illustration, conduit 1404 is shown as a single shortened segment. Of course, to effectively attach quick disconnect connector 2302 to beverage container 402, conduit 1404 is required to have a length sufficient to conveniently attach to beverage container 402 while beverage container 1402 is in the upright position. In the preferred embodiment, conduit 1404 is envisioned as a coil which can be expanded and stored easily. Likewise, the base of system will in practice be large enough to hold the conduit.

Figure 24:
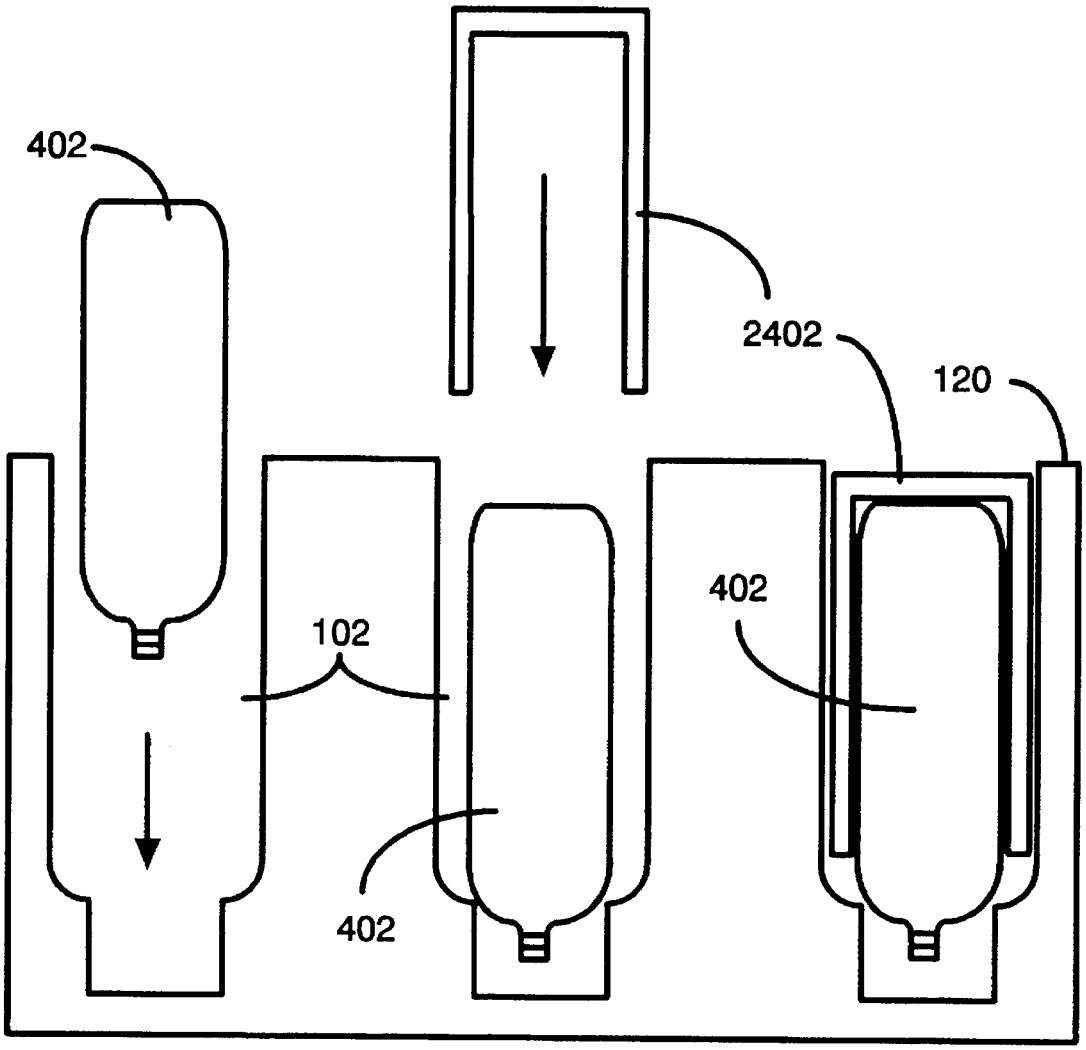
FIG. 24 is an alternative embodiment showing a removable thermal unit for covering the beverage container while it is in the sleeve.

FIG. 24 shows an alternative method of cooling and/or heating the beverage container 402. As shown from left to right, the beverage container 402 slides into a sleeve 102. After beverage container 402 is inserted into sleeve 102, thermal sleeve 2402 is lid into position over beverage container 402. In the preferred embodiment, thermal unit 2402 substantially surrounds the body of beverage container 402 to maximize thermal effectiveness. However, it is possible to construct thermal unit 2402 such that it only partially covers the outside of beverage container 402. Thermal unit 2402 can be constructed of a variety of materials for use both in heating or cooling beverages. The thickness of the walls of the thermal unit is not critical, and will vary based on the designer's choice regarding the balancing of several factors, such as total weight of the container system, sturdiness of the thermal unit material, and the amount of insulation or cooling potential desired. For cooling, a commonly available material such as blue ice can be used. Likewise, insulating materials can also be used for maintaining temperature in hot items such as coffee or soups. An advantage of these removable sleeves is that separate thermal units 2402 allow each sleeve to independently hold hot or cold beverages. An additional advantage of the removable thermal units 2402 is that they may be removed and used independently in the upright position to hold items such as wine. In effect, the thermal unit 2402 can double as a wine cooler.

While the sleeve 102 is shown with a linear side wall for ease of illustration, those skilled in the art will recognize the upper edge of the side wall can be depressed to allow finger access for removal of the thermal units 2402. Likewise, for use of the beverage containers 402 to hold hot items such as soups, it may be advantageous to provide wider diameter conduits 1404 and spigots 104 to accommodate solid pieces of food in a soup. Also, the individual sleeves can vary in size. By so doing, items such as soup can be placed in a larger sleeve to accommodate larger quantities. A further advantage of a larger sleeve 102 is that thermal units 2402 of differing sizes can be used to hold a variety of beverage container 402 sizes securely in place.

While the invention has been described with respect to a preferred embodiment thereof, it will be understood by those skilled in the art that various changes in detail my be made therein without departing from the spirit, scope, and teaching of the invention. For example, any suitable number of sleeves can be used, a variety of conduit connection devices can be used, wall insulation materials can vary, etc. Accordingly, the invention herein disclosed is to be limited only as specified in the following claims.

We claim:

1. A portable container device for dispensing liquids from beverage containers of the type having a pouring mouth, comprising:

a lower container body having a floor and a perimeter wall, the floor and perimeter wall substantially enclosing a storage area for food or beverages;

at least one inner wall extending from a first point on the perimeter wall to a second point on the perimeter wall, the area between the perimeter wall and the inner wall substantially defining at least one sleeve for an inverted beverage container;

a sealing lid removably attached to the upper end of the sleeve such that it forms a watertight seal with the upper end of the sleeve;

conduit means to direct flow of beverage from the mouth of the beverage container to spigot means having an input and an output, the conduit means having a first end, a beverage conduit, and a second end, the first end having means to attach to the mouth of the beverage container and the second end having means to attach to the input of the spigot means;

the spigot means positioned such that it extends through the perimeter wall, the spigot means further having an input connected to the conduit means on the inside of the perimeter wall, having a beverage output port on the outside of the perimeter wall, and having flow control means to initiate or terminate beverage flow; and a lid, removably attachable to the lower container.

2. A portable container device for dispensing liquids from beverage containers of the type having a pouring mouth, comprising:

a lower container body having a floor and a perimeter wall, the floor and perimeter wall substantially enclosing a storage area for food or beverages;

at least one inner wall extending from a first point on the perimeter wall to a second point on the perimeter wall, the area between the perimeter wall and the inner wall substantially defining at least a first sleeve for an inverted beverage container and a second sleeve which forms a storage area;

a cup dispenser, the cup dispenser inserted into the second sleeve;

conduit means to direct flow of beverage from the mouth of the beverage container to spigot means having an input and an output, the conduit means having a first end, a beverage conduit, and a second end, the first end having means to attach to the mouth of the beverage container and the second end having means to attach to the input of the spigot means;

the spigot means positioned such that it extends through the perimeter wall, the spigot means further having an input connected to the conduit means on the inside of the perimeter wall, having a beverage output port on the outside of the perimeter wall, and having flow control means to initiate or terminate beverage flow;

a lid, removably attachable to the lower container and having an aperture of a size such that cups from the cup dispenser can pass through when the lid is attached to the lower container body; and a removable insert to close the lid aperture when the cup dispenser is not in use.

3. A device, as in claim 1, further comprising:

means to accommodate a plurality of beverage container mouth sizes in the first end of the conduit means;

a stopcock in the conduit means to close the beverage conduit while the first end is attached to a beverage container;

spigot removal means to remove the spigot means from the lower container body;

means to pass the second end through the perimeter wall for connection of the second end to the spigot means;

means to access the stopcock such that the stopcock may be opened after the conduit means is attached to the spigot means; and means to reattach the spigot means to the perimeter wall.

4. A device, as in claim 1, further comprising:

means to accommodate a plurality of beverage container mouth sizes in the first end of the conduit means;

a quick disconnect valve in the second end to close the beverage conduit while the first end is attached to a beverage container;

spigot removal means to remove the spigot means from the lower container body;

quick disconnect receptor means between the spigot means and the conduit means such that the quick disconnect valve may be attached to the spigot means with minimal loss of beverage;

means to pass the second end through the perimeter wall for connection of the quick disconnect valve to the quick disconnect receptor means; and means to reattach the spigot means to the perimeter wall.

5. A device, as in claim 1, further comprising:

means to accommodate a plurality of beverage container mouth sizes in the first end of the conduit means; and the first end of the conduit means includes a quick disconnect valve to release or seal the conduit to the beverage container.

6. A portable container device for dispensing liquids from beverage containers of the type having a pouring mouth, comprising:

a lower container body having a floor and a perimeter wall, the floor and perimeter wall substantially enclosing a storage area for food or beverages;

at least one inner wall extending from a first point on the perimeter wall to a second point on the perimeter wall, the area between the perimeter wall and the inner wall substantially defining at least one sleeve for an inverted beverage container;

conduit means to direct flow of beverage from the mouth of the beverage container to spigot means having an input and an output, the conduit means having a first end, a beverage conduit, and a second end, the first end having means to attach to the mouth of the beverage container and the second end having means to attach to the input of the spigot means;

at least one removable thermal unit having an open end and side walls, the inner side of the side walls having a diameter large enough to allow the thermal unit to slide over a portion of a beverage container, and the outer side of the side walls having a diameter small enough to slide within the sleeve;

the spigot means positioned such that it extends through the perimeter wall, the spigot means further having an input connected to the conduit means on the inside of the perimeter wall, having a beverage output port on the outside of the perimeter wall, and having flow control means to initiate or terminate beverage flow; and a lid, removably attachable to the lower container.

7. A device, as in claim 6, further comprising:

at least one indented surface to store extra beverage containers for replacement of the beverage containers in the sleeve; and means to restrain the extra beverage containers from movement during transport.

* * * * *